US011223175B2

(12) United States Patent
Terumichi

(10) Patent No.: US 11,223,175 B2
(45) Date of Patent: Jan. 11, 2022

(54) PLUG FOR USE IN A WIRING DUCT

(71) Applicant: MODULEX INC., Tokyo (JP)

(72) Inventor: Goro Terumichi, Tokyo (JP)

(73) Assignee: MODULEX INC., Tokyo (JP)

( * ) Notice: Subject to any disclaimer, the term of this patent is extended or adjusted under 35 U.S.C. 154(b) by 0 days.

(21) Appl. No.: 16/976,097

(22) PCT Filed: Feb. 28, 2018

(86) PCT No.: PCT/JP2018/007653

§ 371 (c)(1),
(2) Date: Aug. 27, 2020

(87) PCT Pub. No.: WO2019/167202

PCT Pub. Date: Sep. 6, 2019

(65) Prior Publication Data

US 2020/0403362 A1 Dec. 24, 2020

(51) Int. Cl.
*H01R 35/04* (2006.01)
*H01R 25/14* (2006.01)
*H01R 41/00* (2006.01)

(52) U.S. Cl.
CPC ..... *H01R 35/04* (2013.01); *H01R 25/142* (2013.01); *H01R 41/00* (2013.01)

(58) Field of Classification Search
CPC ..... H01R 35/04; H01R 41/00; H01R 25/14; H01R 25/142; H01R 25/147
See application file for complete search history.

(56) References Cited

U.S. PATENT DOCUMENTS 3,646,501 A * 2/1972 Valtonen ..... H01R 25/142 439/122
3,737,834 A * 6/1973 Contratto ..... H01R 25/142 439/118
3,832,503 A * 8/1974 Crane ..... F21V 21/35 200/51 R
4,032,208 A * 6/1977 Berkenhoff ..... H01R 25/142 439/122
4,699,439 A * 10/1987 Cohen ..... H01R 25/142 439/119
4,822,292 A * 4/1989 Thayer ..... H01R 25/142 439/115

(Continued)

FOREIGN PATENT DOCUMENTS

JP S51-102788 U 8/1976
JP S59-43086 U 3/1984

(Continued)

*Primary Examiner* — Travis S Chambers
(74) *Attorney, Agent, or Firm* — Metrolex IP Law Group, PLLC

(57) ABSTRACT

A wiring duct plug that does not have a movable part for selecting any of a plurality of conductive lines, and has a high operational reliability is provided. A wiring duct plug can be directly connected to a respectively corresponding conductive line, and comprises a plurality of movable electrode terminals, rotating together with a rotator. At the connection position, at least two but not all of the plurality of movable electrode terminals are joined into one at the base end portion and electrically coupled to one of non-movable electrode terminals, and the remaining movable electrode terminal is electrically coupled to the other non-movable electrode terminal.

7 Claims, 17 Drawing Sheets

(56) References Cited

U.S. PATENT DOCUMENTS

| | | | | |
|---|---|---|---|---|
| 5,759,051 | A * | 6/1998 | Cancellieri | H01R 25/142 439/118 |
| 6,079,992 | A * | 6/2000 | Kuchar | F21V 17/14 362/287 |
| 6,203,339 | B1 * | 3/2001 | Nieminen | H01R 25/14 439/118 |
| 6,884,095 | B1 * | 4/2005 | Tsai | H01R 25/142 439/118 |
| 6,994,571 | B2 * | 2/2006 | Hoffmann | H01R 13/115 439/110 |
| 7,455,535 | B2 * | 11/2008 | Insalaco | H01R 25/14 439/110 |
| 7,722,367 | B2 * | 5/2010 | Jong | H01R 25/14 439/118 |
| 2019/0337471 | A1 * | 11/2019 | Brehm | B60N 2/08 |

FOREIGN PATENT DOCUMENTS

| | | | |
|---|---|---|---|
| JP | H6-21187 | U | 3/1994 |
| JP | 2001-155534 | A | 6/2001 |
| JP | 2014-22137 | A | 2/2014 |

* cited by examiner

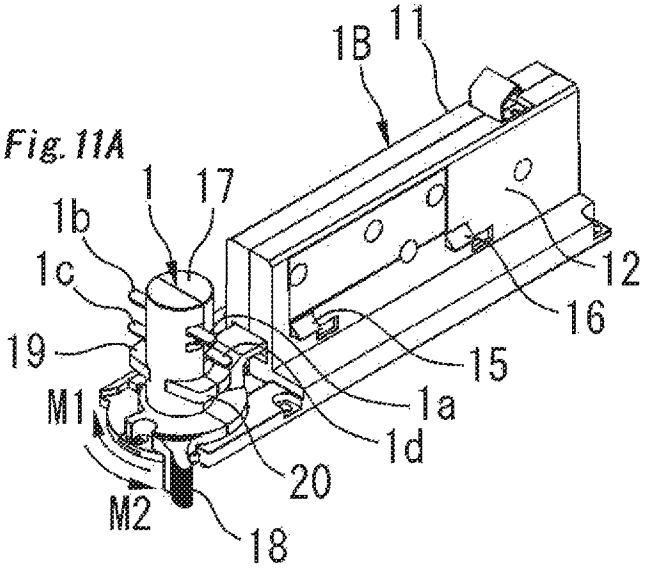
Fig. 11A
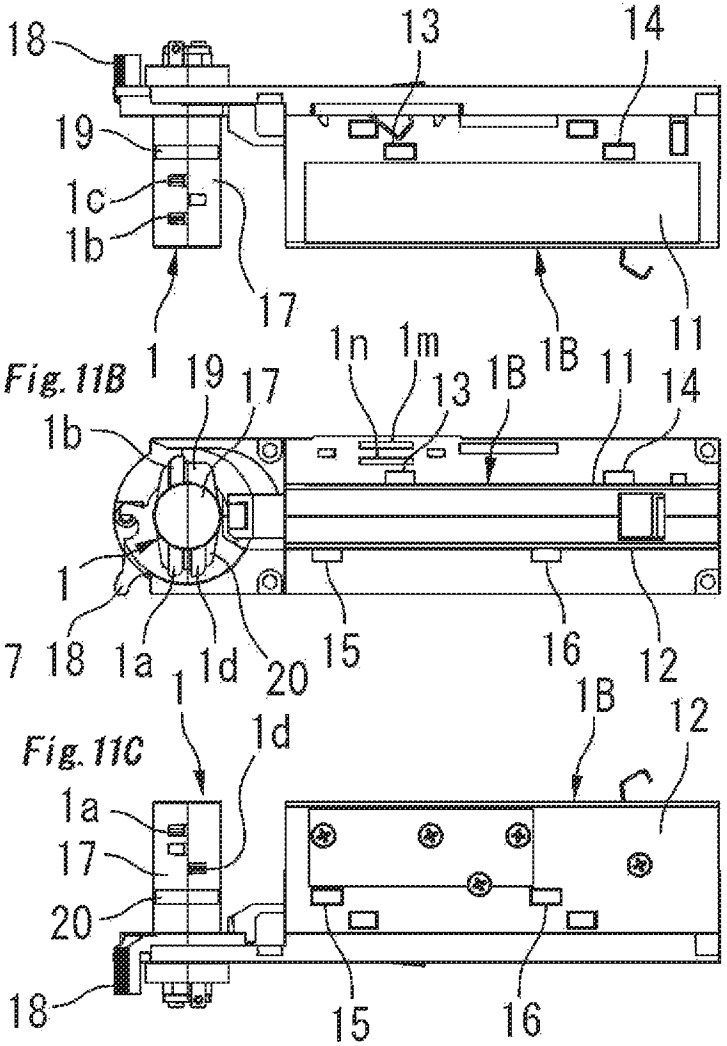
Fig. 11D
Fig. 11B
Fig. 11C
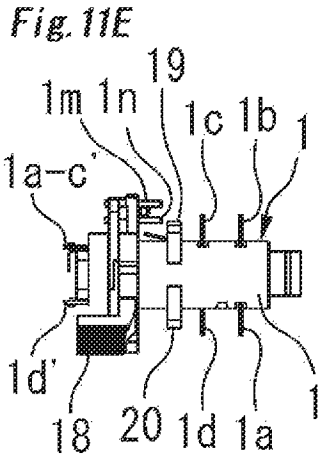
Fig. 11E

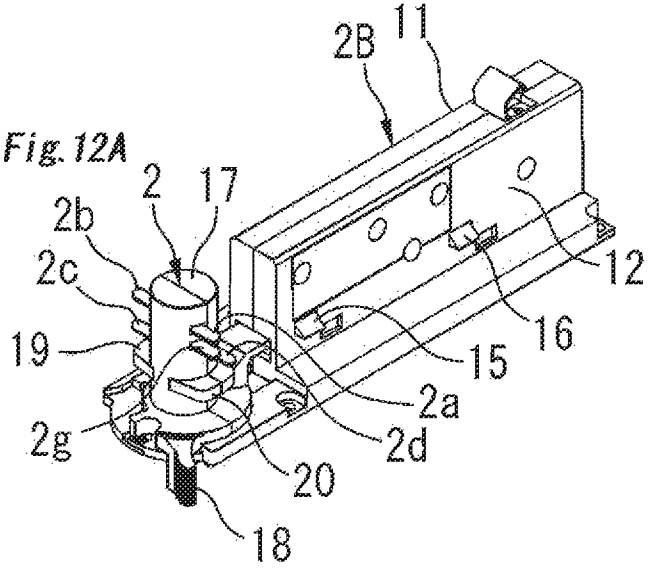
Fig. 12A
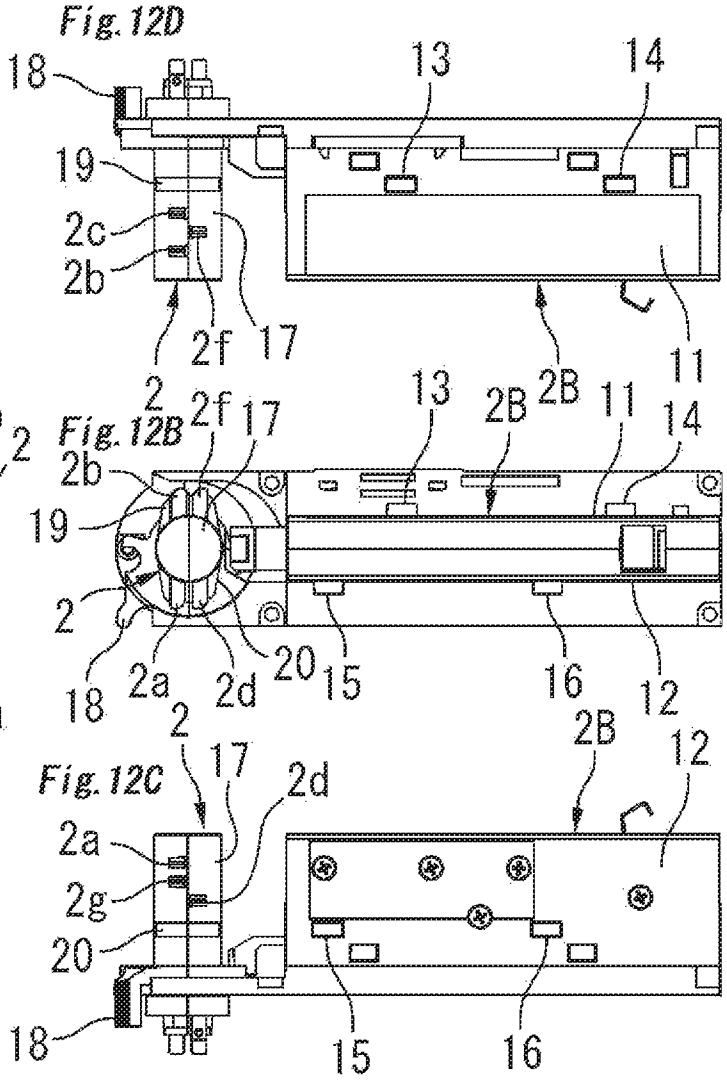
Fig. 12D
Fig. 12B
Fig. 12C
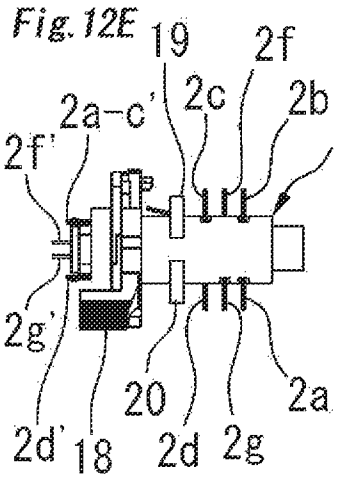
Fig. 12E 4B
4a
4d
20
18
17
4
4b
4e
19

4B
4
4e
4b
18

4B
4e
4d
4
4a
4b
18

4B
17
4
4a
4d
18

4
4b
4a
4e
4d
18
4ab'
4de'

PLUG FOR USE IN A WIRING DUCT

TECHNICAL FIELD

The present invention relates to a wiring duct plug for use mounted in a wiring duct that is installed in a ceiling.

BACKGROUND

As a plug for use in a wiring duct, a plug having an electrical switching means has been conventionally known (see Patent document 1).

This type of plug is described in a patent publication, as a solution in the abstract of as follow:

"A plug 1 is electrically and mechanically coupled to a power distribution duct 20 in which a plurality of conductors 21 are contained. The plug 1 comprises a plug body 4 that includes an insertion portion 2 inserted into and locked with the power distribution duct 20, and an exposed portion 3 that communicates with the insertion portion 2 and is exposed outside the power distribution duct 20. The insertion portion 2 is provided with a conductive portion 11 that can be electrically connected to an arbitrary conductor 21. The plug 4 is provided with an electrical switching means 10 for switching between arbitrary conductors 21 and electrically connecting an arbitrary conductor 21 to the conductive portion 11."

PRIOR ART

Patent Document

[Patent Document 1]: JP-A-2001-155534

SUMMARY

Problems to be Solved by the Invention

According to Patent Document 1, however, the electrical switching means has a movable part for switching, and thus there has been a problem in that its operational reliability is low.

The present invention has been made in view of the circumstance described above. An object of the present invention is to provide a wiring duct plug that does not have any movable part for switching, and thus has an improved operational reliability.

Means to Solve the Problems

To achieve the object described above, one or more embodiments may be provided characterized in that a wiring duct plug mounted to a duct when used, wherein a plurality of conductive wires, lines or the like, are installed in the wiring duct, the plug comprises: a rotatable rotator; a pair of non-movable electrode terminals; and a plurality of movable electrode terminals rotating with the rotator and placed either at a connection position for electrically coupling the plurality of conductive lines to the pair of non-movable electrode terminals, or at a release position for electrically releasing the connection. At the connection position, among the plurality of movable electrode terminals, at least two but not all of the plurality of movable electrode terminals, are capable of being directly coupled to coupled to corresponding ones of the plurality of conductive lines, and the plurality of movable electrode terminals are joined into one at a base end portion and connected or coupled to one of the non-movable electrode terminals. One or more of the remaining movable electrode terminals of the plurality of movable electrode terminals are capable of directly coupling to a corresponding one or more of the remaining conductive lines and to the other non-movable electrode terminal.

THE EFFECT OF THE INVENTION

According to the present invention, the plurality of movable electrode terminals are joined into one at the base end. Therefore, the plurality of movable electrode terminals, when placed at the connection position, electrically couple the plurality of conductive lines to one of the non-movable electrode terminals. As a result, for example, the plurality of movable electrode terminals can electrically couple any of the plurality of conductive lines to one of the non-movable electrode terminals, without the need of selecting one out of the plurality of conductive lines. In other words, no movable part is required for selecting (switching) one out of the plurality of conductive lines, and thus operational reliability can be improved accordingly. The remaining movable electrode terminal connects the remaining conductive lines to the other non-movable electrode terminal.

BRIEF DESCRIPTION OF THE DRAWINGS

FIG. 11A is a perspective view illustrating the plug 1 used in the wiring duct 1A in FIG. 7A.

FIG. 11B is a plan view thereof.

FIG. 11C is a right side view thereof.

FIG. 11D is a left side view thereof.

FIG. 11E is a front view thereof.

FIG. 12A is a perspective view illustrating the plug 2 used in the wiring duct 2A in FIG. 8A.

FIG. 12B is a plan view thereof.

FIG. 12C is a right side view thereof.

FIG. 12D is a left side view thereof.

FIG. 12E is a front view thereof.

EMBODIMENTS FOR IMPLEMENTING THE INVENTION

Figure 1:
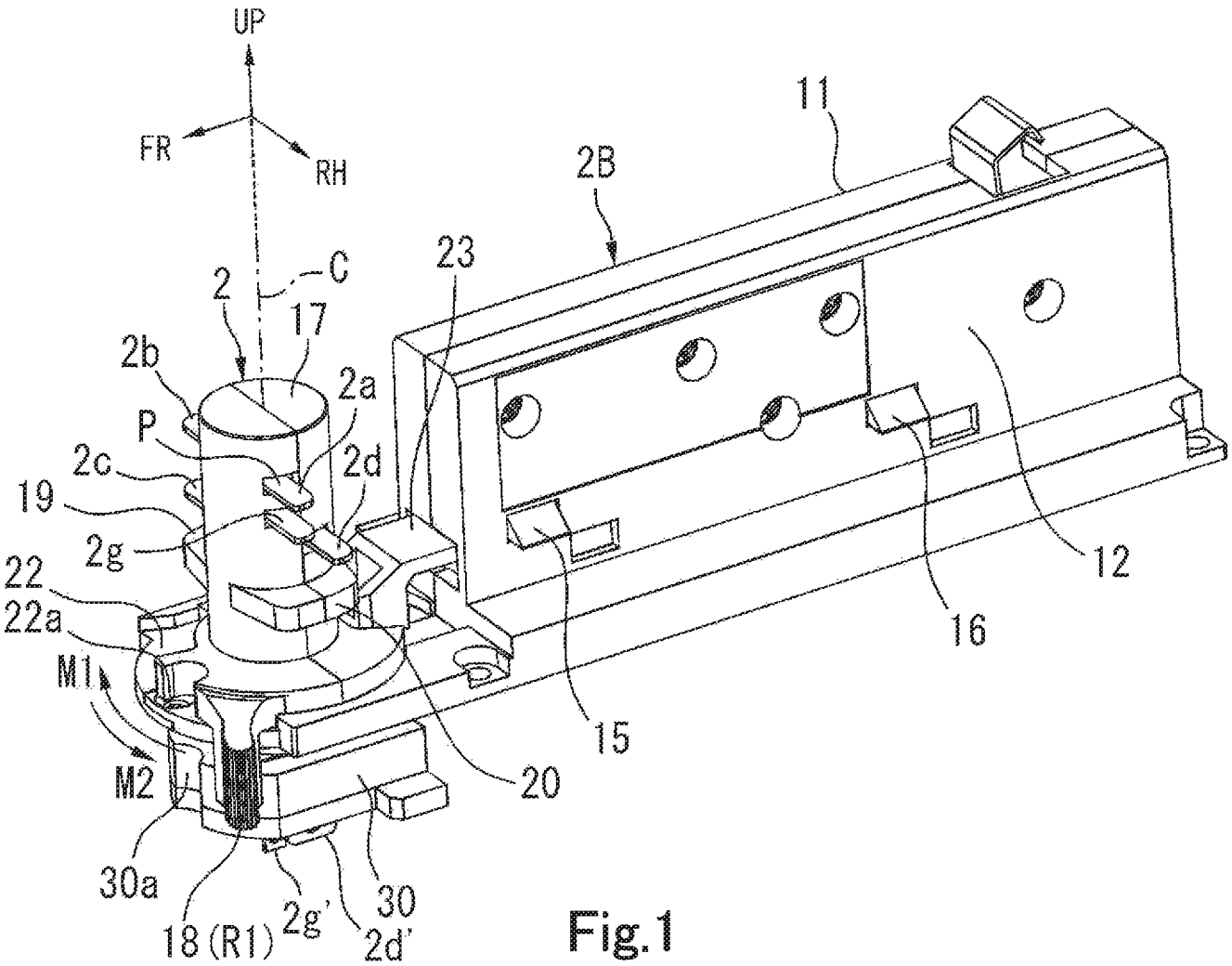
FIG. 1 is a perspective view of a plug 2.

Embodiments to which the present invention is applied are described below in detail, with reference to drawings. In drawings, components designated by the same reference numerals have the same or a similar configuration, and duplicate explanation thereof is omitted as appropriate. In addition, in each drawing, components or the like that are not necessary for explanation are omitted as appropriate.

Embodiment 1

Wiring duct plugs (hereinafter simply referred to as plugs) 1 to 4 according to a first embodiment, to which the present invention is applied, are described with reference to FIGS. 1 to 17. References UP, FR, and RH designated with arrows in FIGS. 1 to 3 respectively indicate upward, front, and rightward of the plug 2 in this order.

Four plugs 1 to 4 are briefly explained below.

The plug 1 is a plug used in a wiring duct 1A (see FIG. 7A) available from a company A for use in Europe and Asia (hereinafter referred to as CE standard), for example. The plug 1 will be described later, with reference to FIG. 7 and FIG. 11.

The plug 1 comprises four movable electrode terminals 1*a* to 1*d*. Three of these movable electrode terminals 1*a* to 1*c* are placed in a forward portion 21A, which is forward from an insulation wall 21, and the movable electrode terminals 1*a* to 1*c* are joined into one at a base end portion K1, and electrically coupled to one non-movable electrode terminal 1*a-c*'. The remaining movable electrode terminal 1*d* is placed in a rearward portion 21B, which is rearward from the insulation wall 21, and electrically coupled to the other non-movable electrode terminal 1*d*'.

The plug 2 is a plug used in a CE-standard wiring duct 2A (see FIG. 8A) available from a company B (different from the company A), for example. The plug 2 will be described later, with reference to FIG. 8 and FIG. 12.

The plug 2 comprises four movable electrode terminals 2*a* to 2*d*. Three of these movable electrode terminals 2*a* to 2*c* are placed in a forward portion 21A, which is forward from an insulation wall 21, and joined into one at a base end portion K2, and electrically coupled to one non-movable electrode terminal 2*a-c*'.

The plug 2 further comprises two movable signal terminals 2*f* and 2*g*. Among them, the movable signal terminal 2*g* is placed in the forward portion 21A, which is forward from the insulation wall 21, and electrically coupled to a non-movable signal terminal 2*g*'. The remaining movable signal terminal 2*f* is placed in a rearward portion 21B, which is rearward from the insulation wall 21, and electrically coupled to a non-movable signal terminal 2*f*'.

The plug 3 is a plug used in a wiring duct 3A (see FIG. 9A) available from the company A for use in U.S. and Canada (hereinafter referred to as UL standard), for example. The plug 3 will be described later, with reference to FIG. 9 and FIG. 13.

The plug 3 comprises four movable electrode terminals 3*a*, 3*b*, 3*d*, and 3*e*. Among them, the two movable electrode terminals 3*a*, 3*b* are placed in a forward portion 21A, which is forward from an insulation wall 21, and joined into one at a base end portion K3*a*, and electrically coupled to one non-movable electrode terminal 3*ab*'. The remaining two movable electrode terminals 3*d* and 3*e* are placed in a rearward portion 21B, which is rearward from the insulation wall 21, and joined into one at a base end portion K3*b*, and electrically coupled to the other non-movable electrode terminal 3*de*'.

The plug 4 is a plug for use in a UL-standard wiring duct 4A available from the company B (see FIG. 10A), for example. The plug 4 will be described later, with reference to FIG. 10 and FIG. 14.

The plug 4 comprises four movable electrode terminals 4*a*, 4*b*, 4*d*, and 4*e*. Among them, the two movable electrode terminals 4*a* and 4*b* are placed in a forward portion 21A, which is forward from an insulation wall 21, and joined into one at a base end portion K4*a*, and electrically coupled to one non-movable electrode terminal 4*ab*'. The remaining two movable electrode terminals 4*d* and 4*e* are placed in a rearward portion 21B, which is rearward from the insulation wall 21, and joined into one at a base end portion K4*b*, and electrically coupled to the other non-movable electrode terminal 4*de*'.

The four plugs 1 to 4 are then described below.

First, the plug 2 is described in detail, with reference to FIGS. 1 to 6.

Figure 2:
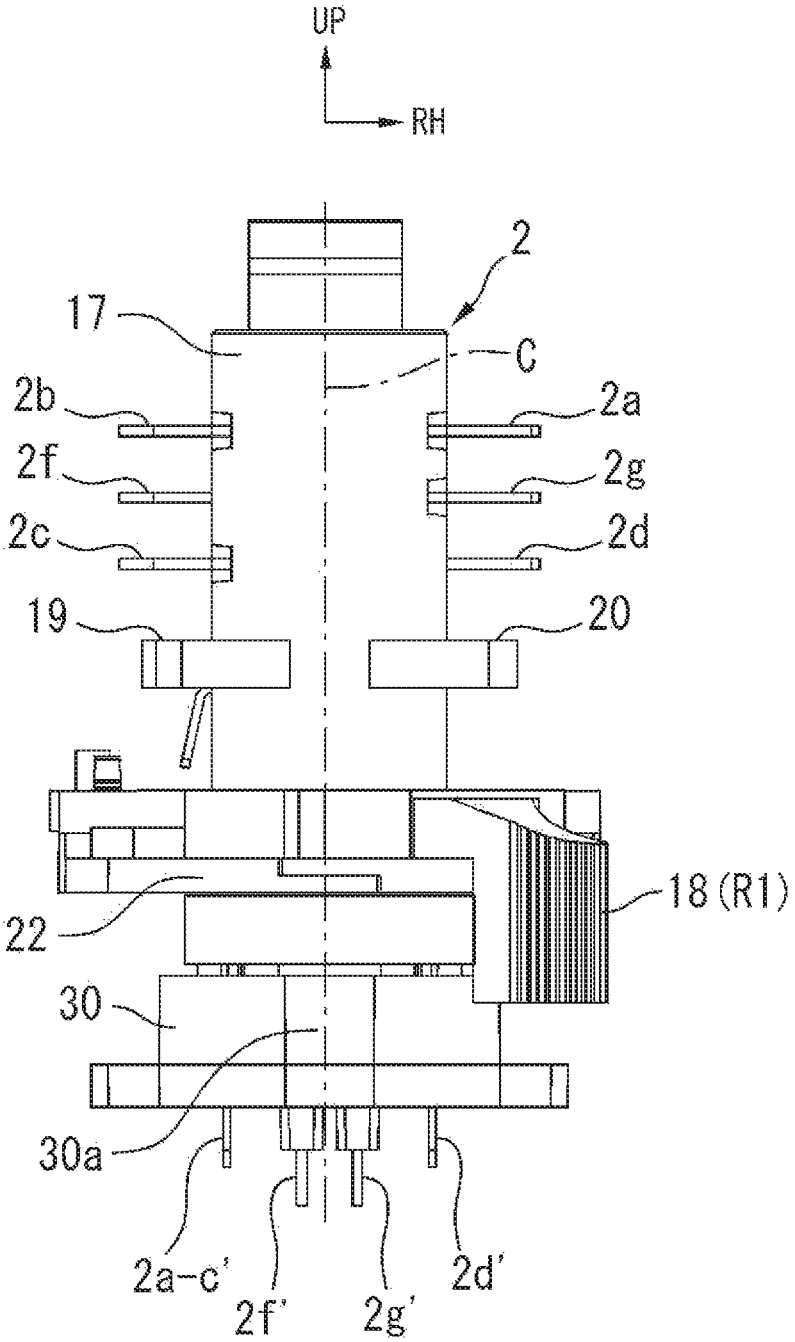
FIG. 2 is a front view of the plug 2.
Figure 3:
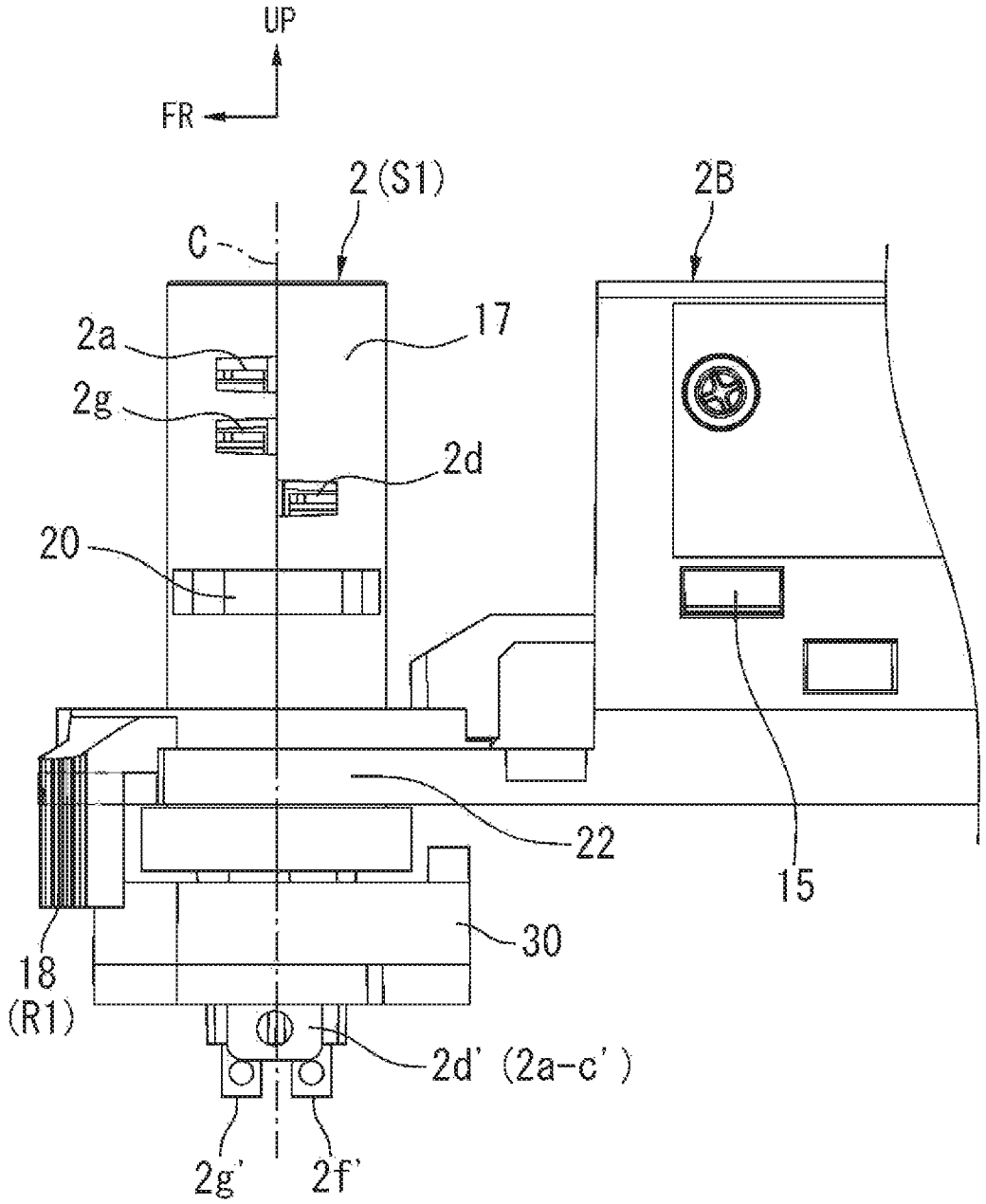
FIG. 3 is a right side view of the plug 2, with a portion thereof being omitted.

Among FIGS. 1 to 6, FIGS. 1 to 3 illustrate the plug 2. FIG. 1 is a perspective view of the plug 2. FIG. 2 is a front view of the plug 2. FIG. 3 is a right side view of the plug 2, with a portion thereof being omitted.

Figure 8C:
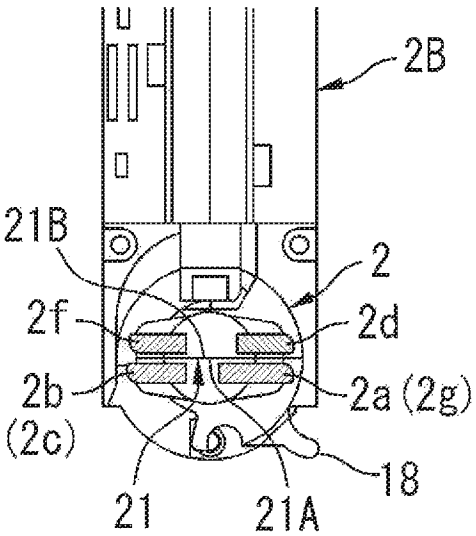
FIG. 8C is a schematic plan view of the plug 2, illustrating the movable electrode terminals 2*a*, 2*b*, and 2*d*, and the movable signal terminal 2*f*.
Figure 8B:
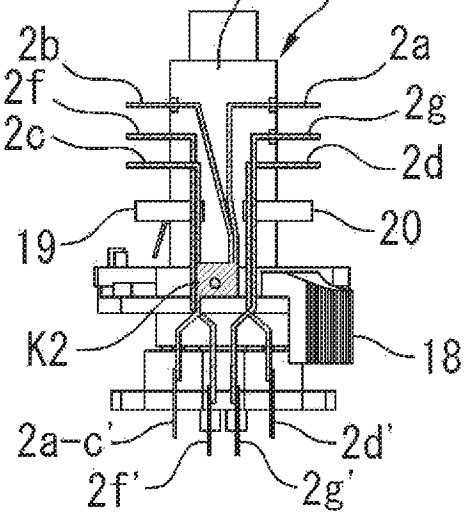
FIG. 8B is a schematic front view of the plug 2, illustrating the movable electrode terminals 2*a* to 2*d*, the movable signal terminals 2*f* and 2*g*, the non-movable electrode terminals 2*a-c*' and 2*d*', and the non-movable signal terminals 2*f*' and 2*g*'.
Figure 8A:
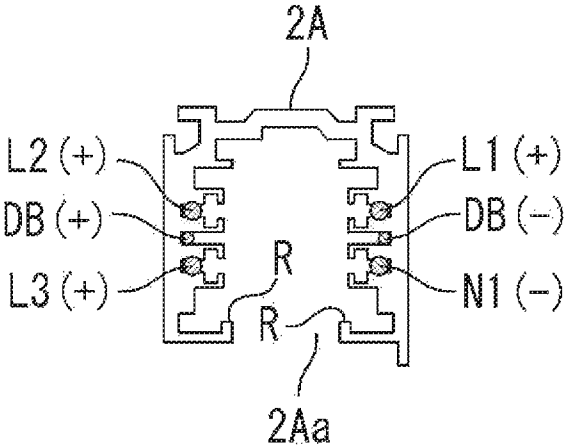
FIG. 8A is a cross sectional view taken perpendicular to the longitudinal direction of a wiring duct 2A.

The plug 2 is mounted to the wiring duct 2A illustrated in FIG. 8A, when used.

A wiring duct 2A is now described with reference to FIG. 8A. FIG. 8A is a cross sectional view taken perpendicular to the longitudinal direction of the wiring duct 2A. As described above, the wiring duct 2A is a CE-standard wiring duct available from the company B, for example. The wiring duct 2A is rectangular in cross section, and has an opening 2Aa at a lower portion. In an upper portion inside the wiring duct 2A, a conductive line L1 (+) is placed on the right and a conductive line L2 (+) is placed on the left. In a middle portion inside the wiring duct 2A, a signal line DB (+) is placed on the left and a signal line DB (−) is placed on the right. In a lower portion inside the wiring duct 2A, a conductive line L3 (+) is placed on the left and a conductive line N1 (−) is placed on the right. In the opening 2Aa, rail portions R and R are provided on the left and right, respectively.

Figure 4:
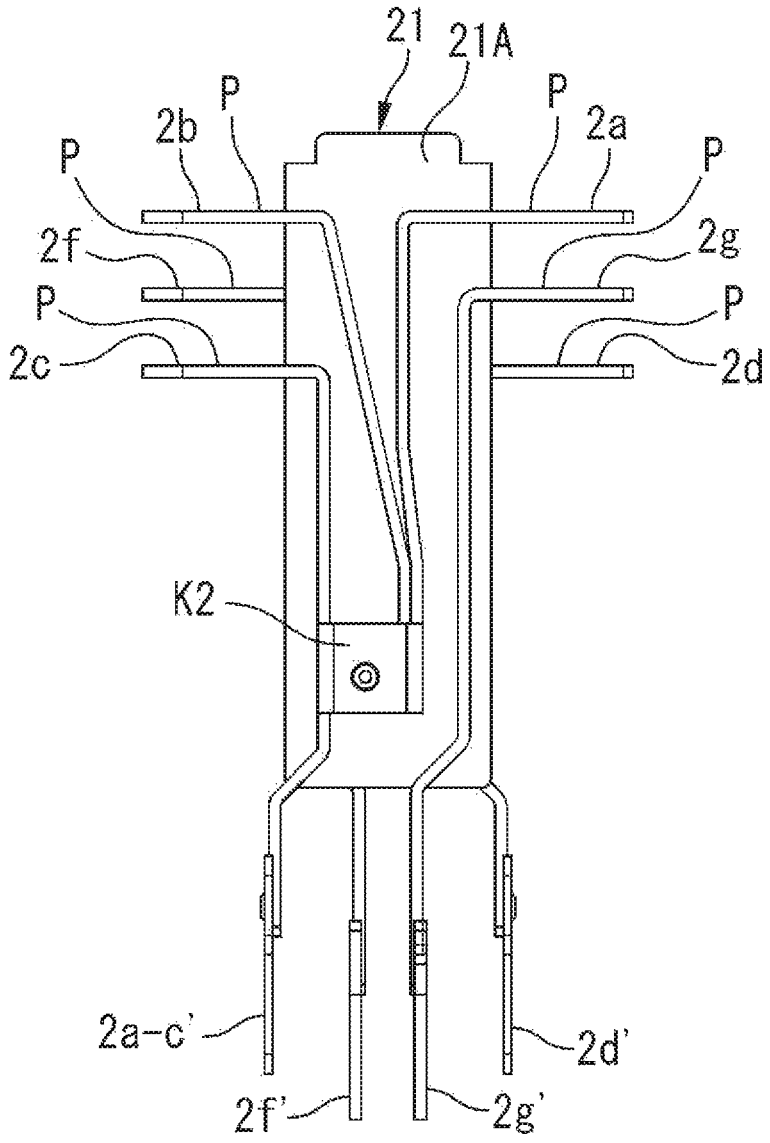
FIG. 4 is a front view of the plug 2, illustrating an insulation wall 21, movable electrode terminals 2*a* to 2*d*, movable signal terminals 2*f* and 2*g*, non-movable electrode terminals 2*a-c*' and 2*d*', and non-movable signal terminals 2*f*' and 2*g*'.
Figure 5:
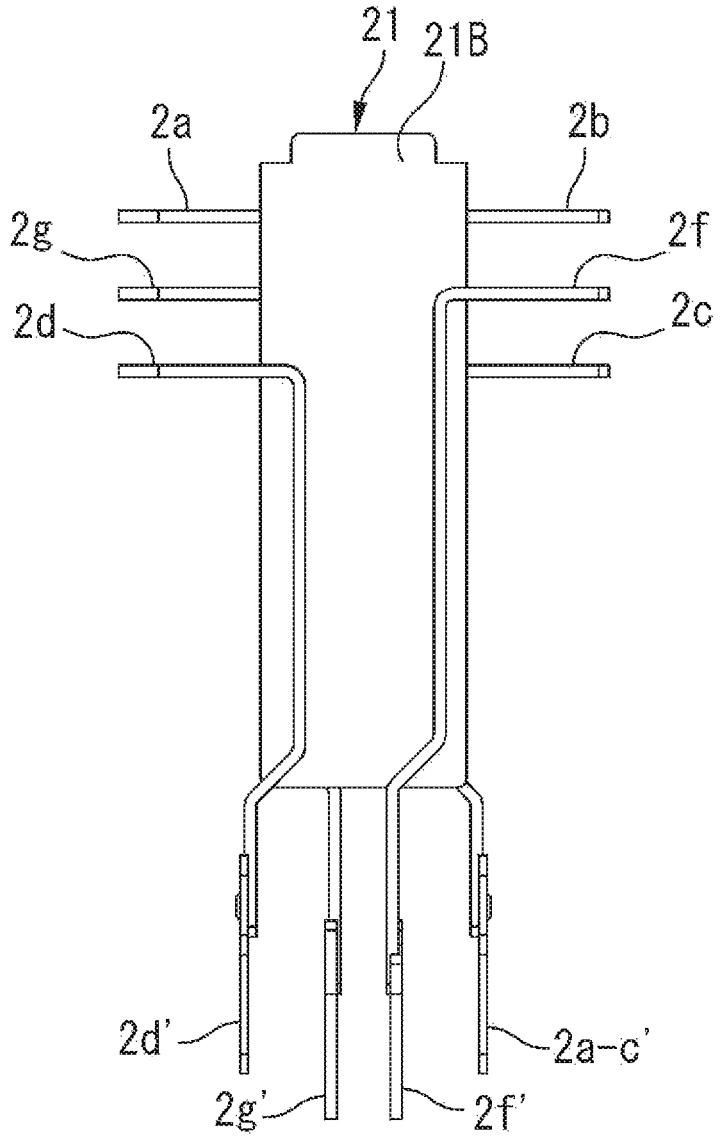
FIG. 5 is a rear view of the plug 2, illustrating the insulation wall 21, the movable electrode terminals 2*a* to 2*d*, the movable signal terminals 2*f* and 2*g*, the non-movable electrode terminals 2*a-c*' and 2*d*', and the non-movable signal terminals 2*f*' and 2*g*'.
Figure 6:
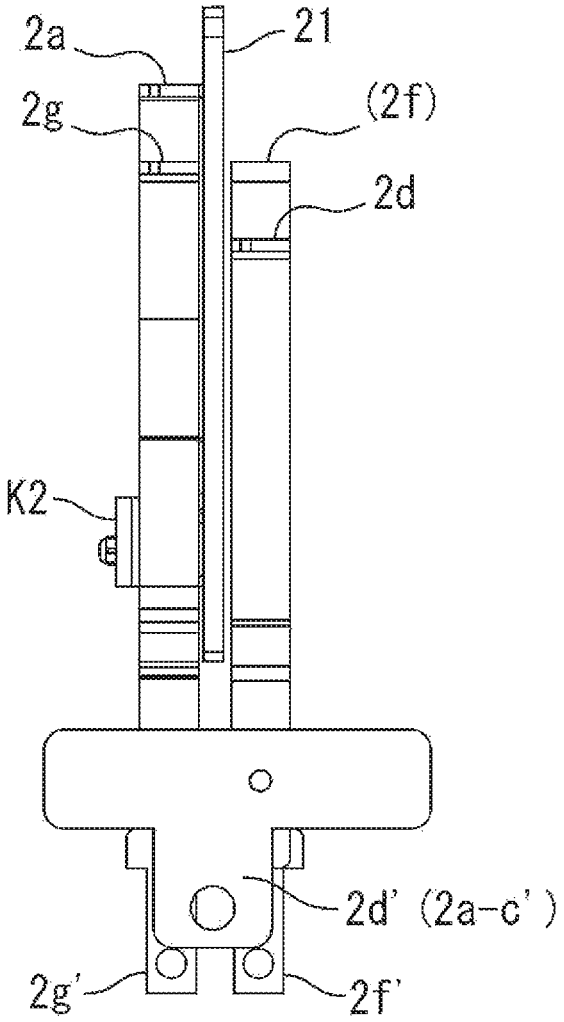
FIG. 6 is a right side view of the plug 2, illustrating the insulation wall 21, the movable electrode terminals 2*a* and 2*d*, the movable signal terminal 2*g*, the non-movable electrode terminal 2*d*', and the non-movable signal terminals 2*f*' and 2*g*'.

Next, the plug 2 is described with reference to FIGS. 1 to 6. FIG. 4 is a front view illustrating the insulation wall 21 of the plug 2, the movable electrode terminals 2*a* to 2*d*, movable signal terminals 2*f* and 2*g*, the non-movable electrode terminals 2*a*-*c*' and 2*d*', and the non-movable signal terminals 2*f*' and 2*g*'. FIG. 5 is a rear view illustrating the insulation wall 21 of the plug 2, the movable electrode terminals 2*a* to 2*d*, the movable signal terminals 2*f* and 2*g*, the non-movable electrode terminals 2*a*-*c*' and 2*d*', and the non-movable signal terminals 2*f*' and 2*g*'. FIG. 6 is a right side view illustrating the insulation wall 21 of the plug 2, the movable electrode terminals 2*a* and 2*d*, the movable signal terminal 2*g*, the non-movable electrode terminal 2*d*', and the non-movable signal terminals 2*f*' and 2*g*'. FIGS. 4 to 6 are respectively a front view, a rear view, and a right side view, illustrating the structure inside (interior space of) a rotator 17 and a non-movable terminal support 30, which are described later.

The plug 2 comprises the rotator 17, the pair of non-movable electrode terminals 2*a*-*c*' and 2*d*', and the plurality of movable electrode terminals 2*a*, 2*b*, 2*c*, and 2*d*, as illustrated in FIGS. 1 to 6. The term "non-movable" in the expression of the non-movable electrode terminal 2*a*-*c*' and 2*d* means that its position is almost unchanged with respect to an adapter 2B, and the term "movable" in the expression of the movable electrode terminals 2*a* to 2*d* means that its position is changed (rotated nearly 90 degrees) with respect to the adapter 2B.

The rotator 17 is rotatable around a rotation axis C that is oriented in a vertical direction. The adapter 2B is disposed behind the rotator 17. The adapter 2B has a substantially rectangular prism shape, which is long in a front-rear direction and thin in a left-right direction. On a left wall surface 11 of the adapter 2B, two lug members 13 and 14 (see FIG. 12) are provided, and two lug members 15 and 16 are provided on a right wall surface 12.

The lug members 13 to 16 are capable of extending from and retracting into the left and right wall surfaces 11, 12, and each has a flat lower surface, which rides on the rails portions R, R in FIG. 8A.

A support portion 22 extending forward is formed in a lower portion of the adapter 2B. The rotator 17 is rotatably supported by the support portion 22. The rotator 17 comprises engagement pieces 19 and 20, which are extending in a left-right direction at a center portion in a vertical direction, and comprises an operation lever 18 at a lower portion in the vertical direction. When the operation lever 18 is placed at a connection position R1 illustrated in FIGS. 1 to 3, a bent portion P at a tip of the movable electrode terminals 2*a* to 2*d*, and the engagement pieces 19 and 20 are oriented to a substantially left-right direction. On the other hand, the movable electrode terminals 2*a* to 2*d* and the engagement pieces 19 and 20 are oriented substantially in a front-rear direction when the operation lever 18 is rotated approximately 90 degrees in the direction of an arrow M1 in FIG. 1. When the operation lever 18 located at a release position is rotated back approximately 90 degrees in the direction of an arrow M2, the operation lever 18 can be placed back to the connection position R1.

In the description below, the positions of the movable electrode terminals 2*a* to 2*d* oriented in a substantially left-right direction, which correspond to the connection position R1 of the operation lever 18, are referred to as "connection positions", and the positions of the movable electrode terminals 2*a* to 2*d* oriented in a substantially front-rear direction, which correspond to the release position of the operation lever 18, are referred to as "release positions". The movable electrode terminals 2*a* to 2*d* will be described in detail below.

A non-movable terminal support portion 30 is provided below the support portion 22 of the adapter 2B. As illustrated in FIG. 1, the non-movable terminal support portion 30 is non-movable with respect to the adapter 2B, because an outer diameter of a volt member (not shown) inserted from above into a screw hole 22*a* of the support portion 22 abuts an abutment portion 30*a*, for example. The non-movable electrode terminals 2*a*-*c*' and 2*d*' and the non-movable signal terminals 2*f*' and 2*g*' having plate-like shapes are secured inside the non-movable terminal support portion 30.

Interior space of the rotator 17 has a substantially cylindrical shape. In a center portion in a front-rear direction in the interior space, the insulation wall 21 illustrated in FIGS. 4 to 6 is disposed to divide the interior space into two portions, forward and rearward. The insulation wall 21 is oriented in a left-right direction, and long in a vertical direction. The plurality of movable electrode terminals 2*a* to 2*d* and the plurality of movable signal terminals 2*f* and 2*g* are placed in the interior space.

Among the plurality of movable electrode terminals 2*a* to 2*d*, three movable electrode terminals 2*a* to 2*c* are placed in a forward portion (one side) 21A, which is forward from the insulation wall 21. Two of the movable electrode terminals 2*a* and 2*b* are placed in an upper stage, where the movable electrode terminal 2*a* is placed on the right and the movable electrode terminal 2*b* is placed on the left. The movable electrode terminal 2*c* is placed on the left in a lower stage.

Three of the movable electrode terminals 2*a* to 2*c* are joined into one at the base end portion (lower end portion) K2. After being joined into one, it is coupled to the non-movable electrode terminal 2*a*-*c*' described above, at the connection position illustrated in FIG. 4.

On the other hand, among the plurality of movable electrode terminals 2*a* to 2*d*, the remaining movable electrode terminal 2*d* is placed in the rearward portion (the other side) 21B, which is rearward from the insulation wall 21. The movable electrode terminal 2*d* is placed on the right in the lower stage. The movable electrode terminal 2*d* is coupled to the non-movable electrode terminal 2*d*' described above, at the connection position illustrated in FIG. 4.

In addition, among the plurality of movable signal terminals 2*f* and 2*g*, the movable signal terminal 2*g* is placed in the forward portion (one side) 21A, which is forward from the insulation wall 21. The movable signal terminal 2*g* is placed on the right in a middle stage. The base end of the movable signal terminal 2*g* is coupled to the non-movable signal terminal 2*g*' described above, at the connection position illustrated in FIG. 4.

Among the plurality of movable signal terminals 2*f* and 2*g*, the movable signal terminal 2*f* is placed in the rearward portion (the other side) 21B, which is rearward from the insulation wall 21. The movable signal terminal 2*f* is placed on the left in the middle stage. The base end of the movable signal terminal 2*f* is coupled to the non-movable signal terminal 2*f*' described above, at the connection position illustrated in FIG. 4.

The plug 2 having the configuration described above as illustrated in FIGS. 1 to 3 is mounted to the wiring duct 2A illustrated in FIG. 8A, when used.

First, the operation lever 18 of the plug 2 is rotated approximately 90 degrees from the connection position R1 in the direction of the arrow M1, and placed at the release position. This operation causes the movable electrode terminals 2*a* to 2*d*, the movable signal terminals 2*f* and 2*g*, and the engaging pieces 19 and 20 to be oriented in the front-rear direction. The front-rear direction of the plug 2 is aligned with the longitudinal direction of the wiring duct 2A, and an upper portion of the plug 2 is inserted from the opening 2Aa of the wiring duct 2A. The lug members 13 to 16 ride on the rail portions R, R, and support the entire plug 2.

When the plug 2 is removed from the wiring duct 2A, the operation lever 18 is rotated from the connection position R1 in the direction of the arrow M1. This operation causes a portion of the rotator 17 to push an interlocking mechanism 23, which is located between the rotator 17 and the adapter 2B, rearward. As a result, the lug members 13 to 16 are forced to retract into the left and right wall surfaces 11 and 12.

Subsequently, the operation lever 18 is rotated in the direction of the arrow M2 and placed back to the original connection position R1. This operation causes the movable electrode terminals 2*a* to 2*c* to electrically couple the conductive lines L1 (+) to L3 (+) to the non-movable electrode terminal 2*a*-*c*', and causes the movable electrode terminal 2*d* to electrically couple the conductive line N1 (−) to the non-movable electrode terminal 2*d*'. In parallel with this operation, the movable signal terminal 2*f* electrically couples the signal line DB (+) to the non-movable signal terminal 2*f*', and the movable signal terminal 2*g* electrically couples the signal line DB (−) to the non-movable signal terminal 2*g*'.

Although the plug 2 has been described as being integrated with the adapter 2B in the description above, the plug 2 does not necessarily have to be integrated with the adapter 2B.

The effects and advantages of the plug 2 described above mainly with reference to FIGS. 1-6, FIG. 8, and FIG. 12 are summarized below.

According to the plug 2, the plurality of movable electrode terminals 2*a* to 2*c* are joined into one at the base end portion K2. The plurality of movable electrode terminals 2*a* to 2*c*, when placed at the connection position, thus electrically couple the plurality of conductive lines L1 (+) to L3 (+) to one of the non-movable electrode terminal 2*a*-*c*'. Therefore, for example, the plurality of movable electrode terminals 2*a* to 2*c* can electrically couple any of the plurality of conductive lines L1 (+) to L3 (+) to the one non-movable electrode terminal 2*a*-*c*', without selecting one out of the plurality of conductive lines L1 (+) to L3 (+). In other words, no movable part for selecting (switching) one conductive line out of the plurality of conductive lines L1 (+) to L3 (+) is required, and thus the operational reliability can be improved accordingly. Note that the remaining movable electrode terminal 2*d* couples the remaining conductive line N1 (−) to the other non-movable electrode terminal 2*d*'.

According to the plug 2, the rotator 17 comprises the insulation wall 21 that divides the interior space into two portions, and the movable electrode terminals 2*a* to 2*c* whose number of terminals is one or more less than the number of the plurality of conductive lines L1 (+) to L3 (+) and N1 (−) are located in the forward portion (one side) 21A of the interior space, which is forward from the insulation wall 21, and the remaining movable electrode terminal 2*d* is located in the rearward portion (the other side) 21B of the interior space, which is rearward from the insulation wall 21. Therefore, for example, the movable electrode terminals 2*a* to 2*c* of positive(+) side, and the movable electrode terminal 2*d* of negative(−) side can be clearly separated by the insulation wall 21.

According to the plug 2, the plurality of movable electrode terminals 2*a* to 2*d* have a deformation center O in the vicinity of the base end portion, thereby a long distance from a bent portion P at the tip to the deformation center O can be obtained. Therefore, it is possible to increase a stroke S of the bent portion P of the movable electrode terminals 2*a* to 2*d*, and to place the movable electrode terminals 2*a* to 2*d* to the connection position with a relatively small force.

According to the plug 2, in addition to the plurality of movable electrode terminals 2*a* to 2*d*, the pair of movable signal terminal 2*f*, 2*g* are provided, and the plurality of movable electrode terminals 2*a* to 2*d* and the pair of movable signal terminals 2*f* and 2*g* are all located in a narrow interior space of the rotator 17.

According to the plug 2, the one movable signal terminal 2*g* is located in the forward portion (one side) 21A of the insulation wall 21, and the other movable signal terminal 2*f* is located in the rearward portion (the other side) 21B of the insulation wall 21. In this way, the one movable signal terminal 2*g* and the other movable signal terminal 2*f* can be clearly separated by the insulation wall 21.

According to the plug 2, the pair of movable signal terminals 2*f* and 2*g* have the deformation center O in the vicinity of the base end portion, thereby a long distance from the bent portion P at the tip to the deformation center O can be obtained. Therefore, it is possible to increase the stroke S of the bent portion P of the movable electrode terminals 2*f* and 2*g*, and to place the movable electrode terminals 2*f* and 2*g* to the connection position with a relatively small force.

The plugs 1 to 4 are described below, with reference to FIGS. 7 to 10. The plug 2 that will be described with reference to FIG. 8 has been described in detail with reference to FIGS. 1 to 6 described above.

Figure 7C:
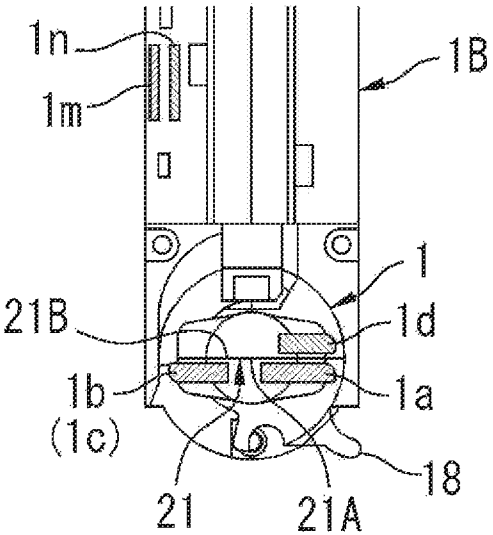
FIG. 7C is a schematic plan view of the plug 1 illustrating the movable electrode terminals 1*a*, 1*b*, and 1*d*.
Figure 7B:
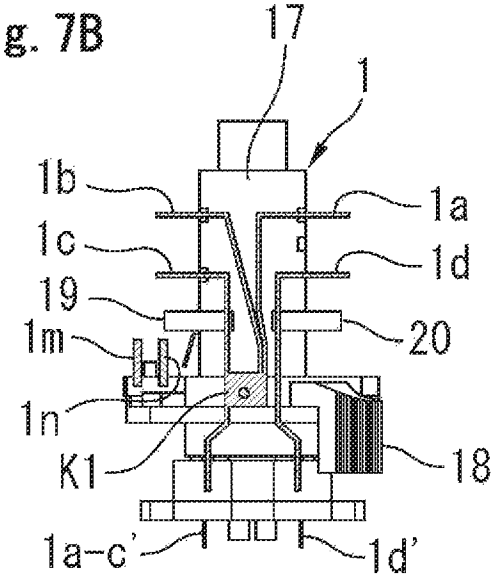
FIG. 7B is a schematic front view of the plug 1 illustrating movable electrode terminals 1*a* to 1*d*, and non-movable electrode terminals 1*a-c*' and 1*d*'.
Figure 7A:
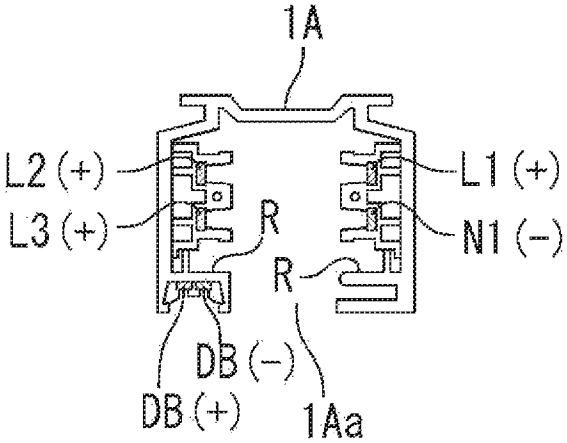
FIG. 7A is a cross sectional view taken perpendicular to the longitudinal direction of a wiring duct 1A.

FIG. 7A is a cross sectional view taken perpendicular to the longitudinal direction of the wiring duct 1A. FIG. 7B is a schematic front view of the plug 1, illustrating the movable electrode terminals 1*a* to 1*d*, and the non-movable electrode terminals 1*a*-*c*' and 1*d*'. FIG. 7C is a schematic plan view of the plug 1, illustrating the movable electrode terminals 1*a*, 1*b*, and 1*d*. In FIG. 7B, the insulation wall 21 is omitted.

FIG. 8A is a cross sectional view taken perpendicular to the longitudinal direction of the wiring duct 2. FIG. 8B is a schematic front view of the plug 2, illustrating the movable electrode terminals 2*a* to 2*d*, the movable signal terminals 2*f* and 2*g*, the non-movable electrode terminals 2*a*-*c*' and 2*d*', and the non-movable signal terminals 2*f*' and 2*g*'. FIG. 8C is a schematic plan view of the plug 2, illustrating the movable electrode terminals 2*a*, 2*b*, 2*d*, and the movable signal terminal 2*f*. In FIG. 8B, the insulation wall 21 is omitted.

Figure 9A:
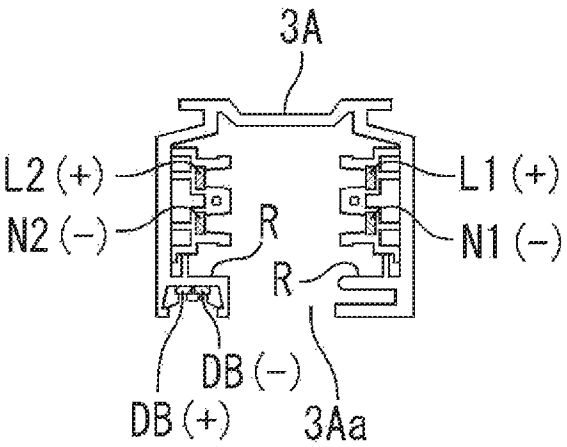
FIG. 9A is a cross sectional view taken perpendicular to the longitudinal direction of a wiring duct 3A.
Figure 9B:
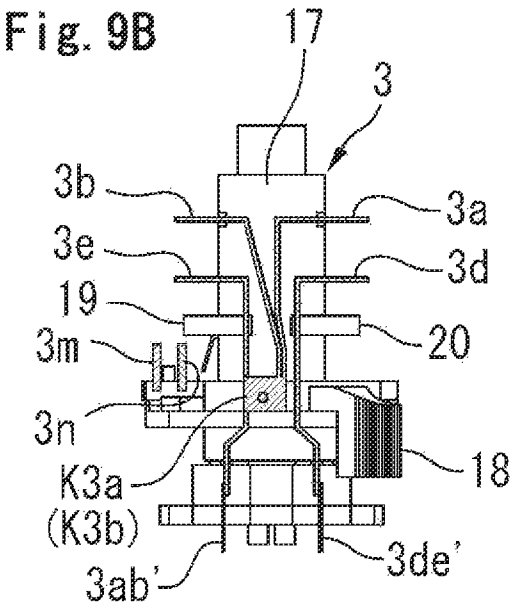
FIG. 9B is a schematic front view of a plug 3, illustrating movable electrode terminals 3*a*, 3*b*, 3*d*, and 3*e*, and non-movable electrode terminals 3*ab*' and 3*de*'.
Figure 9C:
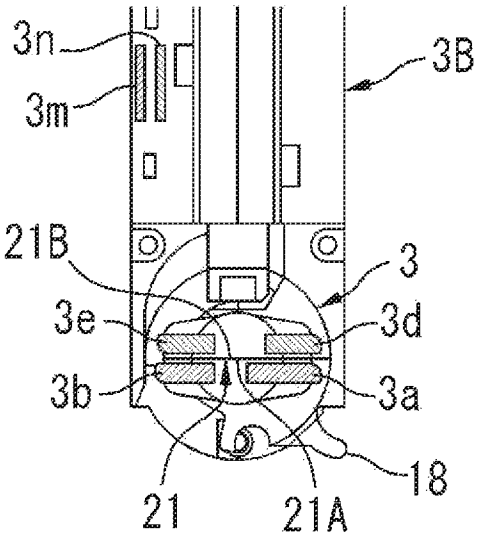
FIG. 9C is a schematic plan view of the plug 3, illustrating the movable electrode terminals 3*a*, 3*b*, 3*d*, and 3*e*.

FIG. 9A is a cross sectional view taken perpendicular to the longitudinal direction of the wiring duct 3A. FIG. 9B is a schematic front view of the plug 3, illustrating the movable electrode terminals 3*a*, 3*b*, 3*d*, 3*e*, and the non-movable electrode terminals 3*ab*' and 3*de*'. FIG. 9C is a schematic plan view of the plug 3, illustrating the movable electrode terminals 3*a*, 3*b*, 3*d* and 3*e*. In FIG. 9B, the insulation wall 21 is omitted.

Figure 10C:
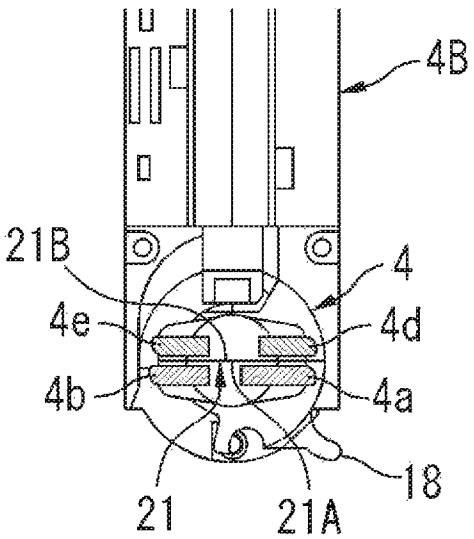
FIG. 10*c* is a schematic plan view of the plug 4, illustrating the movable electrode terminals 4*a*, 4*b*, 4*d*, and 4*e*.
Figure 10B:
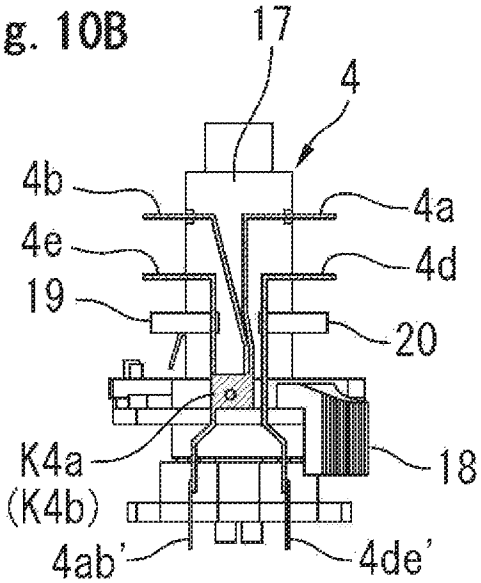
FIG. 10B is a schematic front view of a plug 4, illustrating movable electrode terminals 4*a*, 4*b*, 4*d*, and 4*e*, and non-movable electrode terminals 4*ab*' and 4*de*'.
Figure 10A:
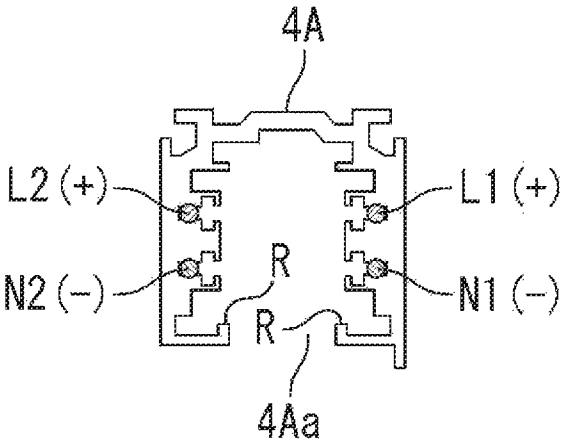
FIG. 10A is a cross sectional view taken perpendicular to the longitudinal direction of a wiring duct 4A.

FIG. 10A is a cross sectional view taken perpendicular to the longitudinal direction of the wiring duct 4A. FIG. 10B is a schematic front view of a plug 4, illustrating the movable electrode terminals 4*a*, 4*b*, 4*d*, 4*e*, and the non-movable electrode terminals 4*ab*' and 4*de*'. FIG. 10*c* is a schematic plan view of the plug 4, illustrating the movable electrode terminals 4*a*, 4*b*, 4*d*, and 4*e*. In FIG. 10B, the insulation wall 21 is omitted.

The wiring duct 1A illustrated in FIG. 7A is a CE-standard wiring duct available from the company A, as described above. The wiring duct 1A comprises conductive lines L1 (+) and L2 (+) placed in an upper stage in the interior space, and conductive lines L3 (+) and N1 (−) placed in a lower stage, along the longitudinal direction. In addition, signal lines DB (+) and DB (−) are provided at an even lower portion than the lower left stage.

The plug 1 illustrated in FIG. 7B and FIG. 7C is mounted to the wiring duct 1A. In the plug 1, the engaging piece 19 and 20 abut the wiring duct 1A from below, and the conductive lines L1 (+), L2 (+), and L3 (+) respectively contact the movable electrode terminals 1*a*, 1*b*, and 1*c*, in this order. The conductive line N1 (−) contacts the movable electrode terminal 1*d*. The movable electrode terminals 1*a*, 1*b*, and 1*c* are joined into one at the base end portion K1, and placed in the forward portion 21A, which is forward from the insulation wall 21 that divides the interior space of the rotator 17 into two portions, forward and rearward. In addition, the movable electrode terminal 1*d* is placed in the rearward portion 21B of the insulation wall 21.

Note that the signal lines DB (+) and DB (−) contact signal terminals 1*m* and 1 *n*, which have different shapes and are disposed external to the rotator 17.

The wiring duct 2A illustrated in FIG. 8A is a CE-standard wiring duct available from the company B, as described above. The wiring duct 2A comprises the conductive lines L1 (+) and L2 (+) placed in an upper stage in the interior space, the signal lines DB (+) and DB (−) placed in a middle stage, and the conductive lines L3 (+) and N1 (−) placed in a lower stage, along the longitudinal direction.

The plug 2 illustrated in FIG. 8B and FIG. 8C is mounted to the wiring duct 2A. In the plug 2, the engaging pieces 19 and 20 abut the wiring duct 2A from below, and the conductive lines L1 (+), L2 (+), and L3 (+) respectively contact the movable electrode terminals 2*a*, 2*b*, and 2*c*, in this order. The conductive line N1 (−) contacts the movable electrode terminal 2*d*. The movable electrode terminals 2*a*, 2*b*, and 2*c* are joined into one at the base end portion K2, and placed in the forward portion 21A, which is forward from the insulation wall 21 that divides the interior space of the rotator 17 into two portions, forward and rearward. In addition, the movable electrode terminal 2*d* is placed in the rearward portion 21B of the insulation wall 21.

Note that the signal lines DB (+) and DB (−) respectively contact the movable signal terminals 2*f* and 2*g*, and the movable signal terminal 2*f* is placed in the rearward portion 21B of the insulation wall 21, and the movable signal terminal 2*g* is placed in the forward portion 21A of the insulation wall 21.

The wiring duct 3A illustrated in FIG. 9A is a UL-standard wiring duct available from the company A, as described above. The wiring duct 3A comprises the conductive lines L1 (+) and L2 (+) placed in an upper stage in the interior space, and the conductive lines N1 (−) and N2 (−) placed in a lower stage, along the longitudinal direction. In addition, signal lines DB (+) and DB (−) are provided at an even lower portion than the left lower stage.

The plug 3 illustrated in FIG. 9B and FIG. 9C is mounted to the wiring duct 3A. In the plug 3, the engaging pieces 19 and 20 abut the wiring duct 3A from below, and the conductive line L1 (+) contacts the movable electrode terminal 3*a*, and the conductive line L2 (+) contacts the movable electrode terminal 3*b*. In addition, the conductive line N1 (−) contacts the movable electrode terminal 3*d*, and the conductive line N2 (−) contacts the movable electrode terminal 3*e*. The movable electrode terminals 3*a* and 3*b* are joined into one at the base end portion K3*a*, and placed in the forward portion 21A, which is forward from the insulation wall 21. In addition, the movable electrode terminals 3*d* and 3*e* are joined into one at the base end portion K3*b*, and placed in the rearward portion 21B, which is rearward from the insulation wall 21.

Note that the signal lines DB (+) and DB (−) contact signal terminals 3*m* and 3*n*, which have different shapes and are disposed external to the rotator 17.

The wiring duct 4A illustrated in FIG. 10A is a UL-standard wiring duct available from the company B, as described above. The wiring duct 4A comprises the conductive lines L1 (+) and L2 (+) placed in an upper stage in the interior space, and the conductive lines N1 (−) and N2 (−) placed in a lower stage, along the longitudinal direction.

The plug 4 illustrated in FIG. 10B and FIG. 10*c* is mounted to the wiring duct 4A. In the plug 4, the engaging piece 19 and 20 abut the wiring duct 4A from below, and the conductive line L1 (+) contacts the movable electrode terminal 4*a* and the conductive line L2 (+) contacts the movable electrode terminal 4*b*. In addition, the conductive line N1 (−) contacts the movable electrode terminal 4*d*, and the conductive line N2 (−) contacts the movable electrode terminal 4*e*. The movable electrode terminals 4*a* and 4*b* are joined into one at the base end portion K4*a*, and placed in the forward portion 21A, which is forward from the insulation wall 21. In addition, the movable electrode 4*d* and 4*e* are joined into one at the base end portion K4*b*, and placed in the rearward portion 21B, which is rearward from the insulation wall 21.

The plugs 1 to 4 used in the wiring ducts 1A to 4A are further explained below, with reference to FIGS. 11 to 14.

FIG. 11A is a perspective view illustrating the plug 1 used in the wiring duct 1A in FIG. 7A. FIG. 11B is a plan view thereof. FIG. 11C is a right side view thereof. FIG. 11D is a left side view thereof. FIG. 11E is a front view thereof.

FIG. 12A is a perspective view illustrating the plug 2 used in the wiring duct 2A in FIG. 8A. FIG. 12B is a plan view thereof. FIG. 12C is a right side view thereof. FIG. 12D is a left side view thereof. FIG. 12E is a front view thereof.

Figure 13A:
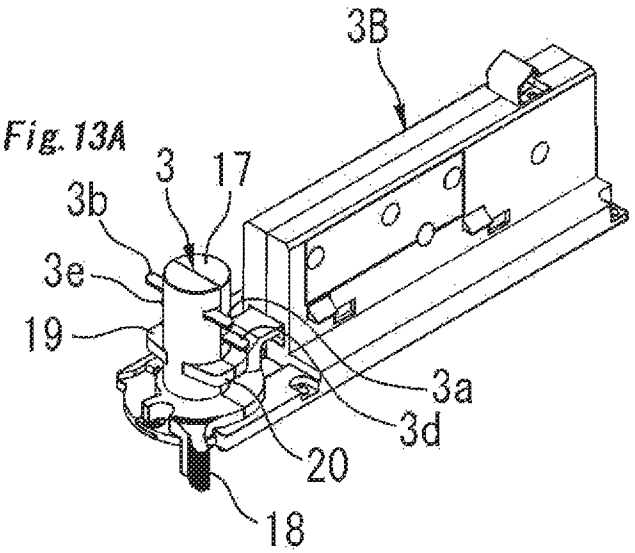
FIG. 13A is a perspective view illustrating the plug 3 used in the wiring duct 3A in FIG. 9A.
Figure 13D:
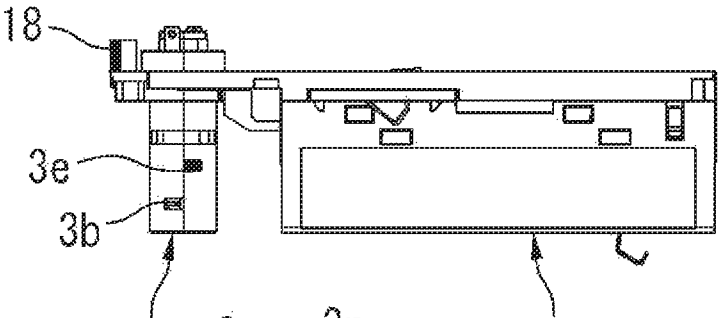
FIG. 13D is a left side view thereof.
Figure 13B:
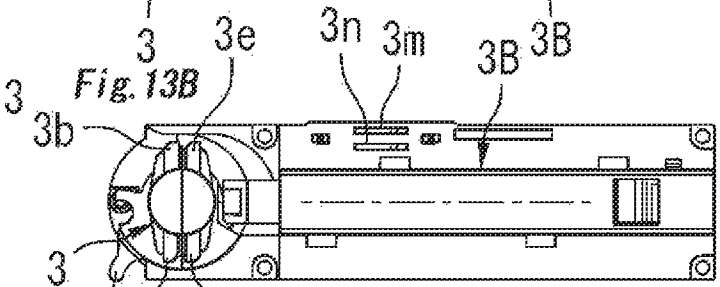
FIG. 13B is a plan view thereof.
Figure 13C:
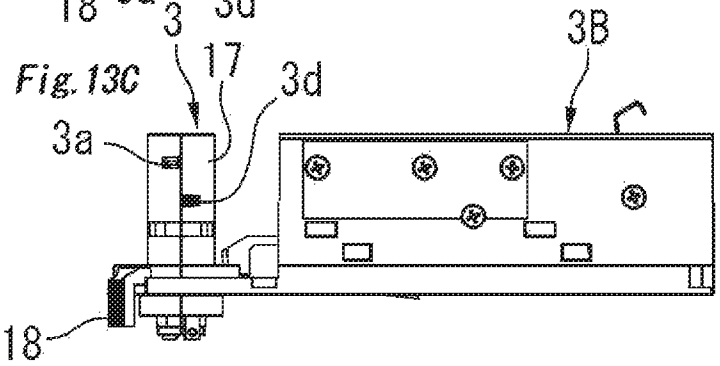
FIG. 13C is a right side view thereof.
Figure 13E:
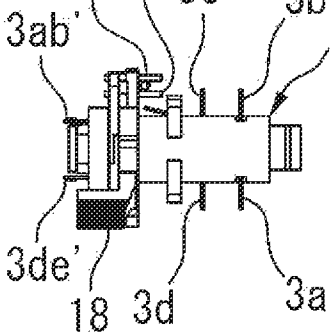
FIG. 13E is a front view thereof.

FIG. 13A is a perspective view illustrating the plug 3 used in the wiring duct 3A in FIG. 9A. FIG. 13B is a plan view thereof. FIG. 13C is a right side view thereof. FIG. 13D is a left side view thereof. FIG. 13E is a front view thereof.

Figures 14A, 14B, 14C, 14D, 14E:
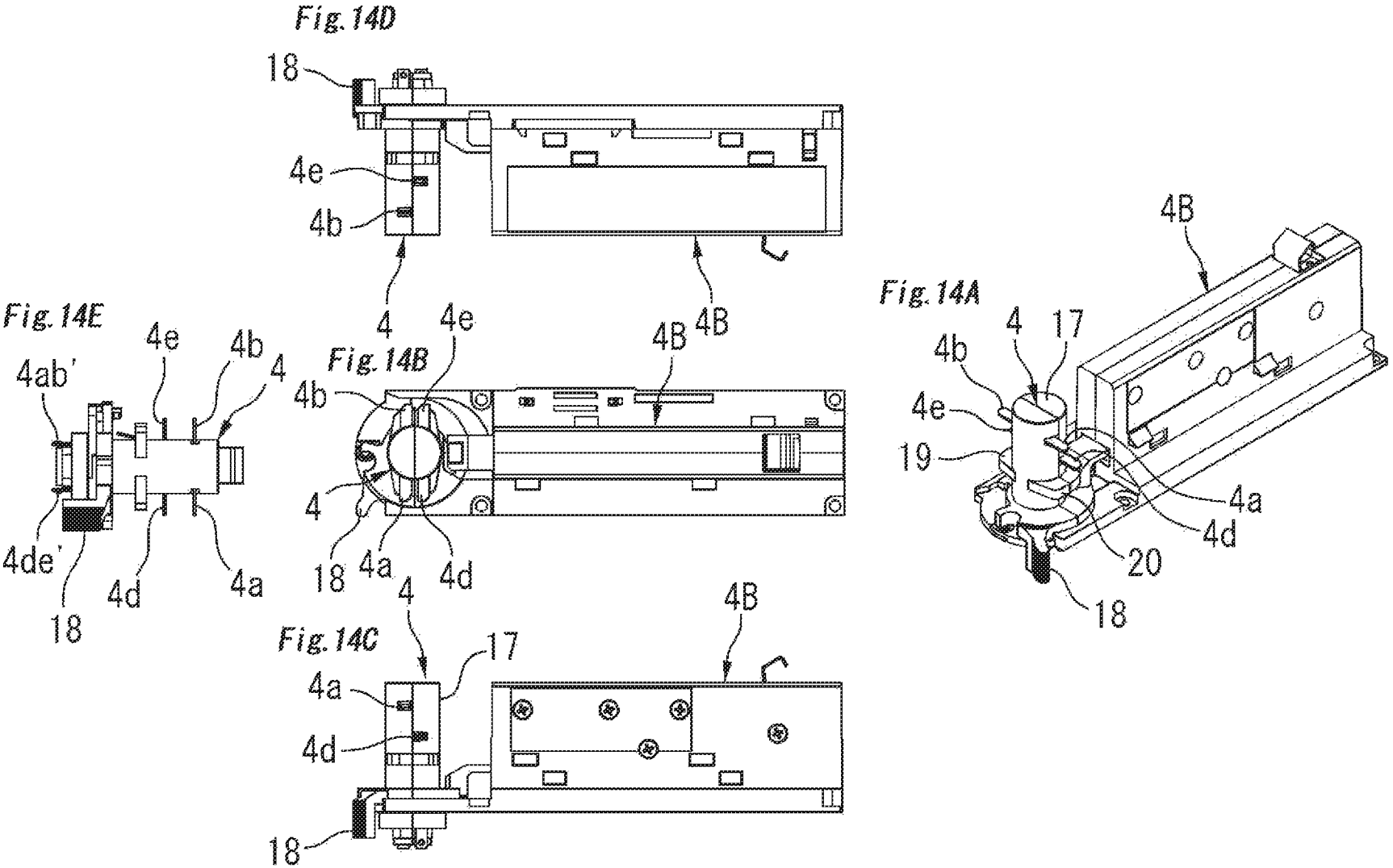
FIG. 14A is a perspective view illustrating the plug 4 used in the wiring duct 4A in FIG. 10A.
FIG. 14B is a plan view thereof.
FIG. 14C is a right side view thereof.
FIG. 14D is a left side view thereof.
FIG. 14E is a front view thereof.

FIG. 14A is a perspective view illustrating the plug 4 used in the wiring duct 4A in FIG. 10A. FIG. 14B is a plan view thereof. FIG. 14C is a right side view thereof. FIG. 14D is a left side view thereof. FIG. 14E is a front view thereof.

As illustrated in FIG. 11A to FIG. 11E, the plug 1 is configured integrally with the adapter 1B that is used in the wiring duct 1A in FIG. 7A.

The adapter 1B has a long rectangular prism shape in the front-rear direction (same as the longitudinal direction of the wiring duct 1A), and has left and right wall surfaces 11 and 12, on which extendable and retractable lug members 13 to 16 are provided. The adapter 1B is suspended at an attachment position of the wiring duct 1A, with its upper portion being entered inside the wiring duct 1A, and the lug members 13 to 16 being suspended on the rail portions R, R of the wiring duct 1A.

The plug 1 is rotatably supported by the adapter 1B. The plug 1 comprises a substantially cylindrical rotator 17, whose rotation axis C (see FIG. 1) is oriented in the vertical direction, and the operation lever 18 secured in the vicinity of a lower end of the plug 1. The movable electrode terminals 1*a* to 1*d* protrude from the rotator 17. The movable electrode terminals 1*a* and 1*b* protrude from an upper stage of the rotator 17 in the left and right directions, and the movable electrode terminals 1*c* and 1*d* protrude from a lower stage in the left and right directions. From a lower portion of the movable electrode terminals 1*c* and 1*d*, the engaging pieces 19 and 20 extend in the left and right directions at a substantially same height as the lug members 13 to 16 described above.

Regarding the positions of the movable electrode terminals 1*a* to 1*c* in the front-rear direction, the movable electrode terminals 1*a* to 1*d* are placed in the forward portion 21A of the insulation wall 21 and the movable electrode terminal 1*d* is placed in the rearward portion 21B of the insulation wall 21, interposing the insulation wall 21 (see FIG. 17) that divides the interior space of the rotator 17 into two portions, forward and rearward.

In the plug 1, the movable electrode terminals 1*a* to 1*d* and the engagement pieces 19 and 20 are oriented in the front-rear direction, when the operation lever 18 is rotated substantially 90 degrees in the direction of the arrow M1 from the connection position R1 illustrated in FIG. 11. This operation allows attachment to the wiring duct 1A by means of the lug members 13 to 16. The movable electrode terminals 1*a* to 1*d* and the engagement pieces 19 and 20 are oriented to the left-right direction when the operation lever 18 is rotated approximately 90 degrees in the direction of the arrow M2, back to the original connection position R1. This operation causes the movable electrode terminals 1*a* to 1*c* to contact the conductive lines L1 (+) to L3 (+), and causes the movable electrode terminal 1*d* to contact the conductive line N1 (−).

As illustrated in FIGS. 12A to 12E, the plug 2 is configured integrally with the adapter 2B that is used in the wiring duct 2A in FIG. 8A. This configuration enables the movable signal terminals 2*f* and 2*g* to contact the non-movable signal terminals 2*f*' and 2*g*', respectively.

The plug 2 has a configuration similar to that of the plug 1, excepting the structure inside the rotator 17, i.e. the structure of the movable electrode terminals. Differences have been described above with reference to FIG. 8B and FIG. 8C.

As illustrated in FIGS. 13A to 13E, the plug 3 is configured integrally with the adapter 3B that is used in the wiring duct 3A in FIG. 9A.

The plug 3 has a configuration similar to that of the plug 1, excepting the structure inside the rotator 17, i.e., the structure of the movable electrode terminals. Differences have been described above with reference to FIG. 9B and FIG. 9C.

As illustrated in FIG. 14A to FIG. 14E, the plug 4 is configured integrally with the adapter 4B that is used in the wiring duct 4A in FIG. 10A.

The plug 4 has a configuration similar to that of the plug 1, excepting the structure inside the rotator 17, i.e., the structure of the movable electrode terminals. Differences have been described above with reference to FIG. 10B and FIG. 10*c*.

The effects and advantages of the plugs 1 described mainly with reference to FIGS. 7 and 11 are summarized below.

According to the plug 1, the plurality of movable electrode terminals 1*a* to 1*c* are joined into one at the base end portion K1. Thus, the plurality of movable electrode terminals 1*a* to 1*c*, when placed at the connection position, electrically couple the plurality of conductive lines L1 (+) to L3 (+) to the one non-movable electrode terminal 1*a*-*c*'. Therefore, for example, the plurality of movable electrode terminals 1*a* to 1*c* can electrically couple any of the plurality of conductive lines L1 (+) to L3 (+) to the one non-movable electrode terminal 1*a*-*c*', without selecting one out of the plurality of conductive lines L1 (+) to L3 (+). In other words, no movable part for selecting (switching) one conductive line out of the plurality of conductive lines L1 (+) to L3 (+) is required, and thus it is possible to increase the operational reliability accordingly. Note that the remaining movable electrode terminal 1*d* couples the remaining conductive line N1 (−) to the other non-movable electrode terminal 1*d*'.

According to the plug 1, the rotator 17 comprises the insulation wall 21 that divides the interior space into two portions. The movable electrode terminals 1*a* to 1*c*, whose number of terminals is one or more less than the number of the plurality of conductive lines L1 (+) to L3 (+) and N1 (−), are placed in the forward portion (one side) 21A of the interior space, and the remaining movable electrode terminal 1*d* is placed in the rearward portion (the other side) 21B of the interior space, interposing the insulation wall 21. Therefore, for example, the movable electrode terminals 1*a* to 1*c* of positive(+) side can be clearly separated from the movable electrode terminal 1*d* of negative(−) side, by the insulation wall 21.

According to the plug 1, the plurality of movable electrode terminals 1*a* to 1*d* have their deformation centers O in the vicinity of the base end portion, and thus a long distance from the bent portion P at the tip to the deformation center O can be obtained. Therefore, it is possible to increase the stroke S of the bent portion P of the movable electrode terminals 1*a* to 1*d*, and place the movable electrode terminals 1*a* to 1*d* at the connection position with a relatively small force.

The effects and advantages of the plug 2 described mainly with reference to FIGS. 8 and 12 are as described above.

Next, the effects and advantages of the plug 3 described mainly with reference to FIGS. 9 and 13 are summarized below.

According to the plug 3, the plurality of movable electrode terminals 3*a* and 3*b* are joined into one at the base end portion K3*a*, and the plurality of movable electrode terminals 3*d* and 3*e* are joined into one at the base end portion K3*b*. Therefore, the plurality of movable electrode terminals 3*a* and 3*b*, when placed at the connection position, electrically couple the plurality of conductive lines L1 (+), and L2 (+) to the one non-movable electrode terminal 1*ab*'. In addition, the plurality of movable electrode terminal 3*d* and 3*e*, when placed at the connection position, electrically couple the plurality of conductive lines N1 (−) and N2 (−) to the other non-movable electrode terminal 1*de*'. Therefore, for example, the plurality of movable electrode terminals 3*a* and 3*b* can electrically couple either of the conductive lines L1 (+) or L2 (+) to the one non-movable electrode terminal 1*ab*', without selecting one out of the plurality of conductive lines L1 (+) and L2 (+). In addition, the plurality of movable electrode terminal 3*d* and 3*e* can electrically couple either of the conductive line N1 (−) or N2 (−) to the one non-movable electrode terminal 1*de*', without selecting one out of the plurality of conductive lines N1 (−) and N2 (−). In other words, no movable part for selecting (switching) one conductive line out of the plurality of conductive lines L1 (+) and L2 (+) is required, and no movable part for selecting (switching) one conductive line out of the plurality of conductive lines N1 (−) and N2 (−) is required, and thus it is possible to increase the operational reliability accordingly.

According to the plug 3, the rotator 17 comprises the insulation wall 21 that divides the interior space into two portions, and the movable electrode terminals 3*a* and 3*b*, whose number of terminals is one or more less than the number of the plurality of conductive lines L1 (+), L2 (+), N1 (−), and N2 (−), are placed in the forward portion (one side) 21A of the interior space, which is forward from the insulation wall 21, and the remaining movable electrode terminals 3*d* and 3*e* are placed in the rearward portion (the other side) 21B of the interior space, which is rearward from the insulation wall 21. Therefore, for example, the movable electrode terminals 3*a* and 3*b* of positive(+) side can be clearly separated from the movable electrode terminal 3*d* and 3*e* of negative(−) side, by the insulation wall 21.

According to the plug 3, the plurality of movable electrode terminals 3*a* and 3*b* have their deformation centers O in the vicinity of the base end portion K3*a*, and the plurality of movable electrode terminal 3*d* and 3*e* have their deformation centers O in the vicinity of the base end portion K3*b*, thereby a long distance from the bent portion P at the tip to the deformation center O can be obtained. Therefore, it is possible to increase the stroke S of the bent portion P of the movable electrode terminals 3*a*, 3*b*, 3*d*, and 3*e*, and place the movable electrode terminals 3*a*, 3*b*, 3*d*, and 3*e* at the connection position with a relatively small force.

The effects and advantages of the plug 4 described mainly with reference to FIGS. 10 and 14 are similar to those of the plug 3 described above, and thus explanation thereof is omitted.

Figure 15B:
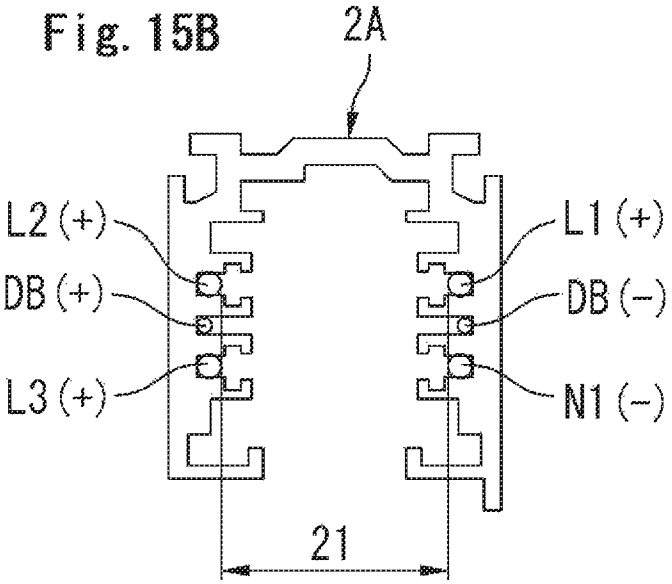
FIG. 15B is an enlarged view of the wiring duct 2A in FIG. 8A.
Figure 15A:
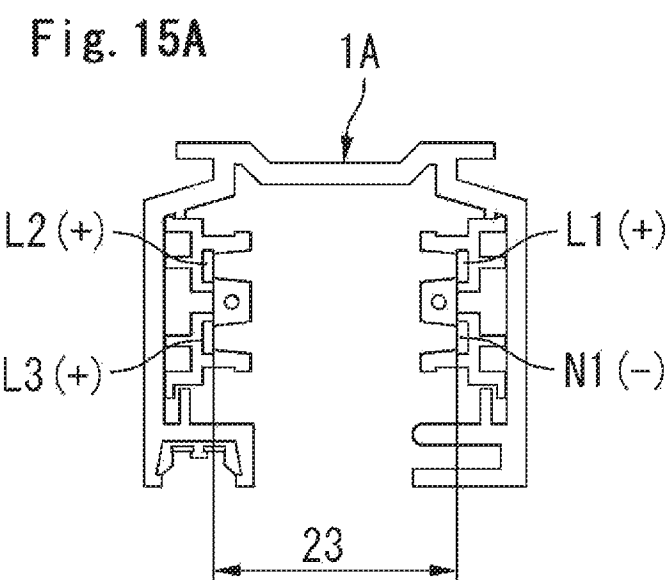
FIG. 15A is an enlarged view of the wiring duct 1A in FIG. 7A.

FIG. 15A is an enlarged view of the wiring duct 1A in FIG. 7A. FIG. 15B is an enlarged view of the wiring duct 2A in FIG. 8A.

Figure 16A:
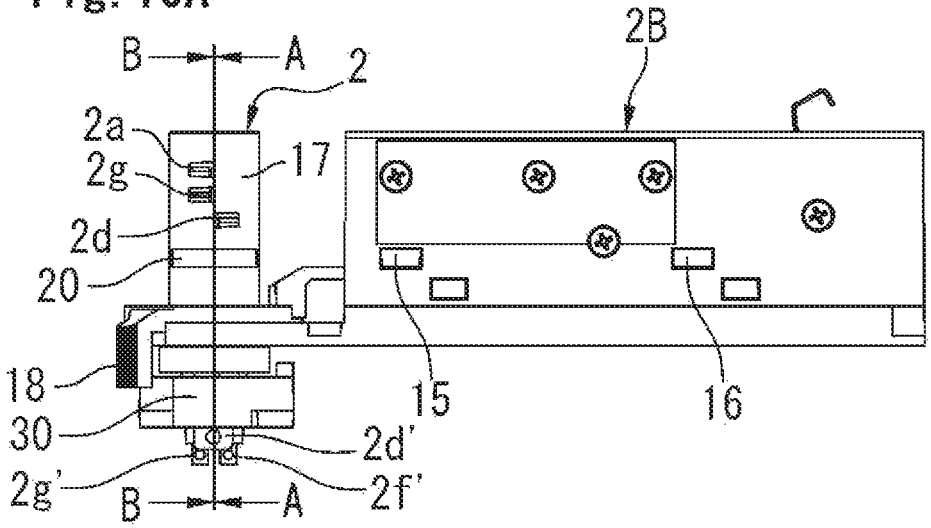
FIG. 16A is a right side view of the plug 2.
Figure 16B:
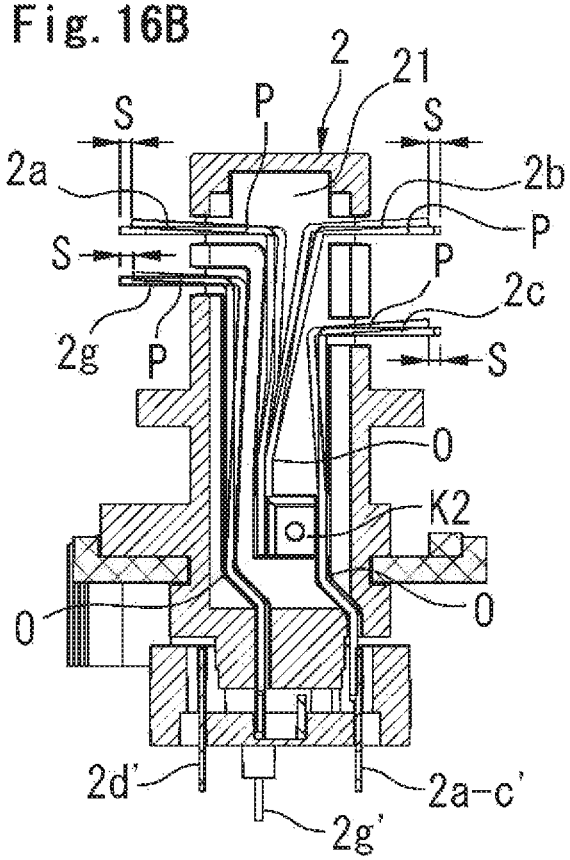
FIG. 16B is a view cut along A-A line in FIG. 16A.
Figure 16C:
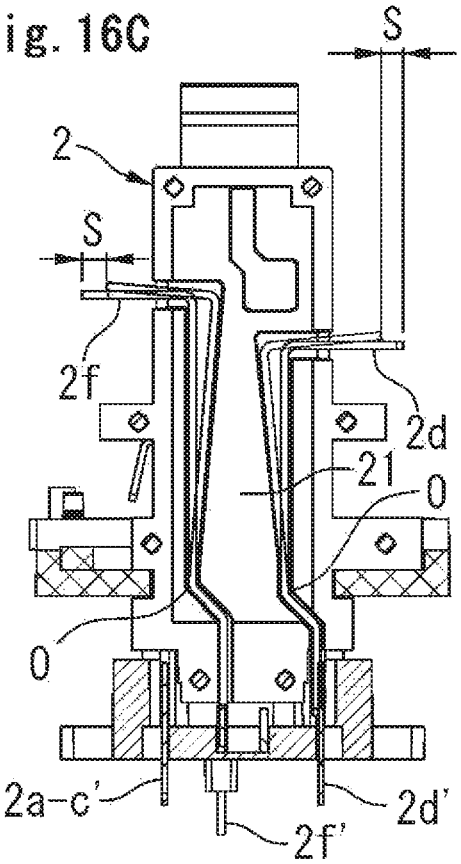
FIG. 16C is a view cut along B-B line in FIG. 16A.

FIG. 16A is a right side view of the plug 2. FIG. 16B is a view cut along A-A line in FIG. 16A. FIG. 16C is a view cut along B-B line in FIG. 16A.

As illustrated in FIG. 15A, in the wiring duct 1A, the distance between the left and right conductive lines L1 (+) and L2 (+) is 23 mm, for example. On the other hand, as illustrated in FIG. 15B, in the wiring duct 2A, the distance between the left and right conductive lines L1 (+) and L2 (+) is 21 mm for example, resulting in a difference of 2 mm (=23 mm−21 mm).

In order to compensate for this 2-mm difference, the deformation centers O of the movable electrode terminals 2*a* to 2*d* and the movable signal terminal 2*f* and 2*g* are located at a position as far as possible from the bent portion P at their respective tips, as illustrated in FIG. 16A to FIG. 16C, thereby the stroke S is secured.

As a result, the plugs 1 and 2 available from different companies A and B of the same CE-standard can be made in common, simply by changing the internal structure of their respective rotators 17. In other words, simply by changing the arrangement or the like of the movable electrode terminals 2*a* to 2*d* and the movable signal terminals 2*f* and 2*g*, other components such as the rotator 17, adapter, non-movable terminal support portion 30 or the like can be in common, without any change.

In addition, by setting the deformation center O of the plug 2 to a position as far as possible from the bent portion P at the tip of the plug 2 in this manner, it is possible to reduce resistance caused by the plug 2 when the plug 2 is rotated in the direction of the arrow M2 (see FIG. 11). Same can be said for the plugs 3 and 4 that are available from different companies A and B, but having the same UL standard.

In addition, as illustrated in FIGS. 16A to 16C, the movable electrode terminals 2*a*, 2*b*, 2*c* of the plug 2 are joined into one at the base end portion K2 so that the movable terminal 2*a*, 2*b*, 2*c* are electrically integrated, and placed in the forward portion 21A of the insulation wall 21. The movable electrode terminal 2*d* is placed in the rearward portion 21B of the insulation wall 21.

By electrically connecting and integrating the base end portion K2 of the movable electrode terminals 2*a*, 2*b*, 2*c* in this manner, a constructor who uses the wiring duct 2A may install three conductive lines L1 (+), L2 (+), and L3 (+), or may install one of them.

In the description above, the plug 2 has been explained as an example, but the explanation is also applicable to the plug 1, 3, or 4.

Figure 17A:
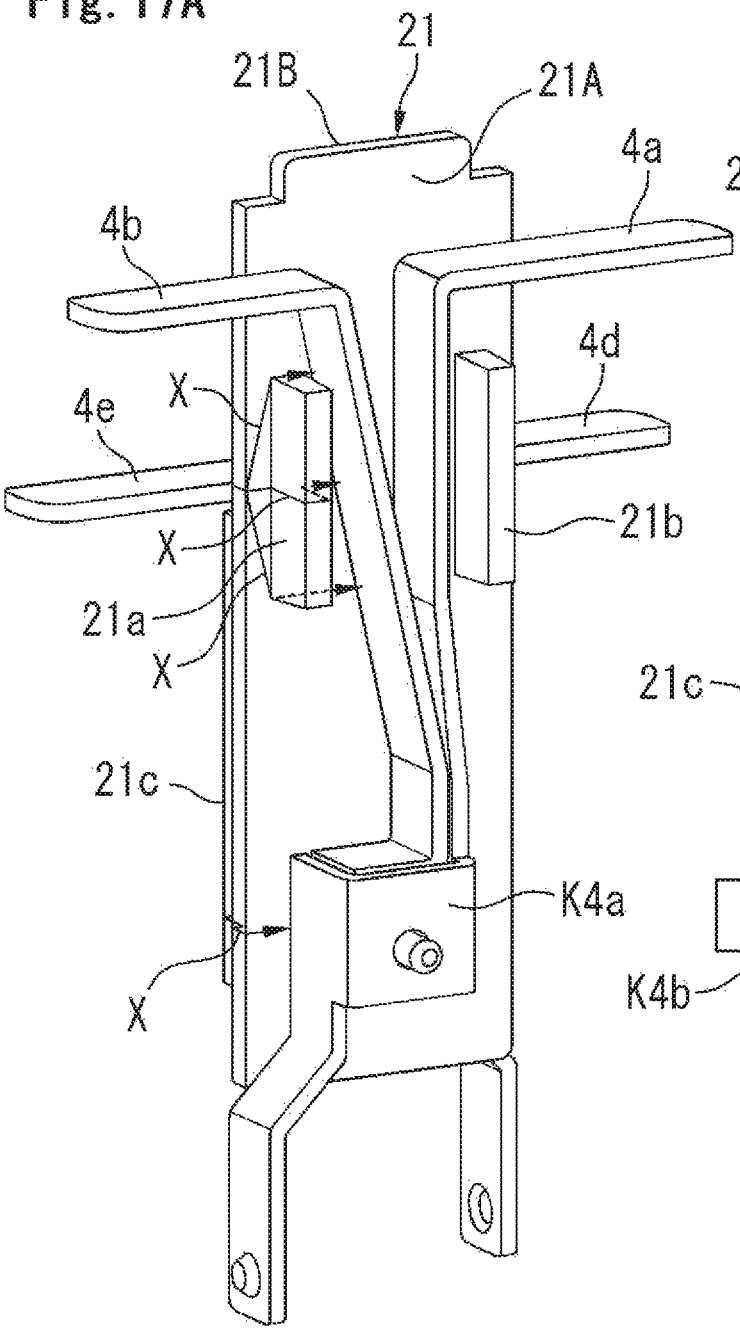
FIG. 17A is a perspective view illustrating the insulation wall 21 of the plug 4, the movable electrode terminals 4*a* and 4*b* in a forward portion 21A thereof, and the movable electrode terminal 4*d* and 4*e* in a rearward portion 21B thereof.
Figure 17B:
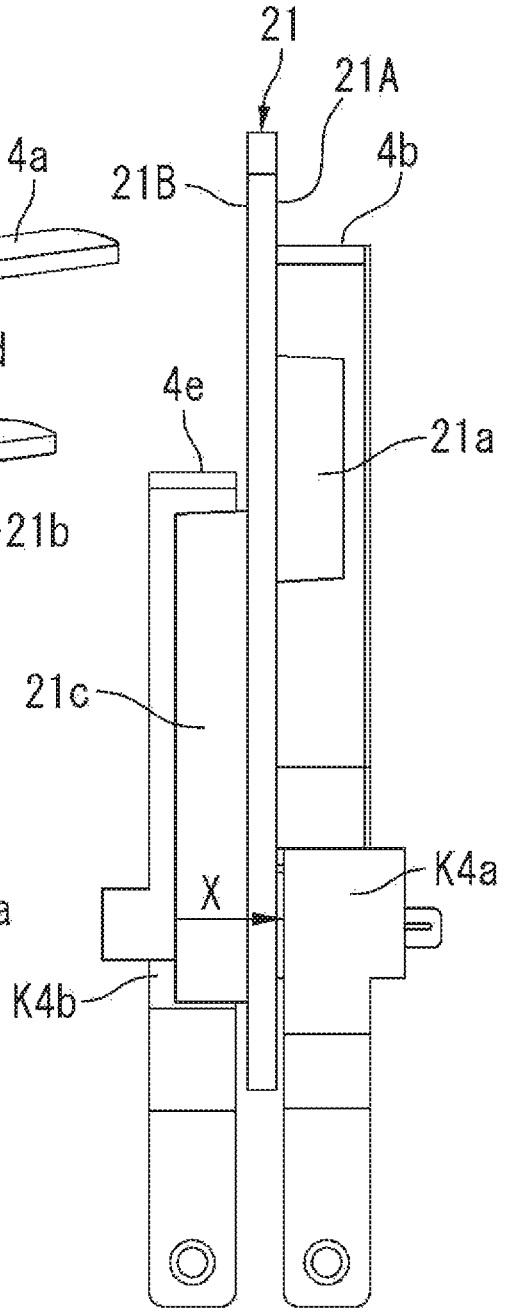
FIG. 17B is a left side view of the insulation wall 21.

FIG. 17A is a perspective view illustrating the insulation wall 21 of the plug 4, the movable electrode terminals 4*a* and 4*b* in its forward portion 21A, and the movable electrode terminal 4*d*, 4*e* in its rearward portion 21B. FIG. 17B is a left side view of the insulation wall 21.

As illustrated in FIGS. 17A and 17B, the insulation wall 21 comprises insulation ribs 21*a* and 21*b* in the forward portion 21A, and an insulation rib 21*c* in the rearward portion 21B, in order to obtain a creepage distance X.

In the embodiments described above, the plugs 1 to 4 are configured integrally with the adapters 1B to 4B, respectively, but the plugs 1 to 4 may be configured separately from the adapters 1B to 4B.

DESCRIPTION OF REFERENCES

1-4: Plug (Plug for wiring duct)

1A-4A: Wiring duct

1B-4B: Adapter

1*a*-1*d*, 2*a*-2*d*, 3*a*, 3*b*, 3*d*, 3*e*, 4*a*, 4*b*, 4*d*, 4*e*: Movable electrode terminal

2*a*-*c*', 2*d*': Non-movable electrode terminal

2*f*, 2*g*: Movable signal terminal
2*f*', 2*g*': Non-movable signal terminal
17: Rotator
21: Insulation wall
21A: Forward portion (one side)
21B: Rearward portion (the other side)
DB (+), DB (−): Signal line
K1, K2, K3*a*, K3*b*, K4*a*, K4*b*: Base end portion
L1 (+), L2 (+), L3 (+), N1 (−), N2 (−): Conductive line
O: Deformation center
P: Bent portion
R1: Connection position

The invention claimed is:

1. A wiring duct plug for use mounted in a wiring duct in which a plurality of conductive lines are installed, the plug comprising:

a rotatable rotator;

a pair of non-movable electrode terminals; and a plurality of movable electrode terminals, rotating with the rotator and placed either at a connection position for electrically coupling the plurality of conductive lines to the pair of non-movable electrode terminals, or at a release position for releasing electrical connection, wherein, when placed at the connection position, among the plurality of movable electrode terminals, at least two but not all of the plurality of movable electrode terminals are capable of being directly coupled to corresponding ones of the plurality of conductive lines, and are joined into one at a base end portion and coupled to one of the non-movable electrode terminals, and one or more of remaining movable electrode terminals of the plurality of movable electrode terminals are capable of directly coupling to a corresponding one or more of remaining conductive lines and to the other non-movable electrode terminal.

2. The wiring ducting plug according to claim 1:

wherein the rotator comprises an insulation wall that divides interior space into two portions, the at least two but not all of the plurality of the movable electrode terminals are placed in one of the portions of the interior space divided by the insulation wall, and the one or more of remaining movable electrode terminals are placed in the other portion of the interior space divided by the insulation wall.

3. The wiring duct plug according to claim 1:

wherein the plurality of movable electrode terminals comprise a deformation center in the vicinity of the base end portion.

4. The wiring duct plug according to claim 1:

wherein the remaining movable electrode terminals are at least two movable electrode terminals, and the remaining movable electrode terminals are joined into one at a base end portion and coupled to the other non-movable electrode terminal.

5. The wiring duct plug according to claim 1:

wherein a pair of signal lines are installed in the wiring duct, the plug comprising:

a pair of non-movable signal terminals; and a pair of movable signal terminals rotating with the rotator, wherein the pair of movable signal terminals are configured to: when placed at the connection position, electrically couple the pair of signal lines to the pair of non-movable signal terminals; and when placed at a release position, release electrical connection, wherein, when placed at the connection position, the one of the movable signal terminals couples the one of the signal lines and the one non-movable signal terminal, and the other movable signal terminal couples the other signal line and the other non-movable signal terminal.

6. The wiring duct plug according to claim 5:

wherein the rotator comprises an insulation wall that divides interior space into two portions, the at least two but not all of the plurality of the movable electrode terminals are placed in one of the portions of the interior space divided by the insulation wall, the one or more remaining movable electrode terminals are placed in the other portion of the interior space divided by the insulation wall, the one of the movable signal terminals is placed in one of the portions divided by the insulation wall, and the other one of the movable signal terminals is placed in the other portion divided by the insulation wall.

7. The wiring duct plug according to claim 5:

wherein the pair of movable signal terminals have a deformation center in the vicinity of the base end portion.

* * * * *